US010784093B1

(12) United States Patent
Yip

(10) Patent No.: US 10,784,093 B1
(45) Date of Patent: Sep. 22, 2020

(54) CHUNKING ALGORITHM FOR PROCESSING LONG SCAN DATA FROM A SEQUENCE OF MASS SPECTROMETRY ION IMAGES

(71) Applicant: Thermo Finnigan LLC, San Jose, CA (US)

(72) Inventor: Ping F. Yip, Salem, MA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/375,542

(22) Filed: Apr. 4, 2019

(51) Int. Cl.
*H01J 49/00* (2006.01)
*H01J 49/42* (2006.01)

(52) U.S. Cl.
CPC ..... *H01J 49/0036* (2013.01); *H01J 49/42* (2013.01)

(58) Field of Classification Search
CPC ..... H01J 49/0036; H01J 49/42
USPC ..... 250/281, 282
See application file for complete search history.

(56) References Cited

U.S. PATENT DOCUMENTS

| | | | | |
|---|---|---|---|---|
| 8,389,929 | B2 | 3/2013 | Schoen et al. | |
| 9,337,009 | B2 | 5/2016 | Grothe, Jr. | |
| 10,020,174 | B2 | 7/2018 | Zhang et al. | |
| 10,032,254 | B2 | 7/2018 | Harmeling et al. | |
| 10,488,377 | B2 | 11/2019 | Wang et al. | |
| 2005/0288872 | A1 | 12/2005 | Old et al. | |
| 2010/0105572 | A1* | 4/2010 | Kris | C12Q 1/6816 506/10 |
| 2011/0028337 | A1* | 2/2011 | Bradley | C07D 239/36 506/9 |
| 2011/0215235 | A1 | 9/2011 | Schoen et al. | |
| 2013/0072420 | A1* | 3/2013 | Skerra | A61P 5/00 514/1.1 |
| 2015/0311050 | A1 | 10/2015 | Smith et al. | |
| 2016/0030517 | A1* | 2/2016 | Morrison | A61P 25/16 514/17.7 |
| 2016/0138091 | A1* | 5/2016 | Chee | C12Q 1/6853 506/2 |

OTHER PUBLICATIONS

Picaud et al., "Linear MALDI-ToF simultaneous spectrumdeconvolution and baseline removal", BMC Bioinformatics (2018), 19:123, 20 pages.

Polanski et al., "Signal Partitioning Algorithm for Highly Efficient Gaussian Mixture Modeling in Mass Spectrometry", (2015) PLoS One 10(7): e0134256. https://doi.org/10.1371/journal.pone.0134256.

* cited by examiner

*Primary Examiner* — Nicole M Ippolito
(74) *Attorney, Agent, or Firm* — David A. Schell

(57) ABSTRACT

A system and method for processing long scan data from a mass spectrometer is described. The long scan data is broken into multiple discrete subsets and each of the multiple subsets are padded by adding additional strings of data on either end of the subset. Each of the multiple subsets is deconvolved and overhang errors are corrected for on each deconvolved subset. A deconvolved full data set is then assembled from the deconvolved subsets.

20 Claims, 13 Drawing Sheets

Example Chunk of Data zero-padded to a length of 50,000 points

Real part of the deconvolution coefficients for data chunk

Zoomed view of data chunk

Magnitudes of the deconvolution coefficients are below $1e^{-5}$ below 10,000 and above 40,000

Reconstructing the chunked data padded to only 16,000 data points
by a full deconvolution of the deconvolution coefficients (also 16,000 points)

CHUNKING ALGORITHM FOR PROCESSING LONG SCAN DATA FROM A SEQUENCE OF MASS SPECTROMETRY ION IMAGES

TECHNICAL FIELD

The present disclosure relates to the field of mass spectrometry. More particularly, the present disclosure relates to a mass spectrometer system and method that features improved processing for long scan data sets by processing the long scan data in smaller discrete data subsets or "chunks".

BACKGROUND OF THE INVENTION

Quadrupole mass analyzers are one type of mass analyzer used in mass spectrometry. As the name implies, a quadrupole consists of four rods, usually cylindrical or hyperbolic, set in parallel pairs to each other, as for example, a vertical pair and a horizontal pair. These four rods are responsible for selecting sample ions based on their mass-to-charge ratio (m/z) as ions are passed down the path created by the four rods. Ions are separated in a quadrupole mass filter based on the stability of their trajectories in the oscillating electric fields that are applied to the rods. Each opposing rod pair is connected together electrically, and a radio frequency (RF) voltage with a DC offset voltage is applied between one pair of rods and the other. Ions travel down the quadrupole between the rods. Only ions of a certain mass-to-charge ratio will be able to pass through the rods and reach the detector for a given ratio of voltages applied to the rods. Other ions have unstable trajectories and will collide with the rods. This permits selection of an ion with a particular m/z or allows the operator to scan for a range of m/z-values by continuously varying the applied voltage.

By setting stability limits via applied RF and DC potentials that are capable of being ramped as a function of time, such instruments can be operated as a mass filter, such that ions with a specific range of mass-to-charge ratios have stable trajectories throughout the device. In particular, by applying fixed and/or ramped AC and DC voltages to configured cylindrical but more often hyperbolic electrode rod pairs in a manner known to those skilled in the art, desired electrical fields are set-up to stabilize the motion of predetermined ions in the x and y dimensions. As a result, the applied electrical field in the x-axis stabilizes the trajectory of heavier ions, whereas the lighter ions have unstable trajectories. By contrast, the electrical field in the y-axis stabilizes the trajectories of lighter ions, whereas the heavier ions have unstable trajectories. The range of masses that have stable trajectories in the quadrupole and thus arrive at a detector placed at the exit cross section of the quadrupole rod set is defined by the mass stability limits.

Typically, quadrupole mass spectrometry systems employ a single detector to record the arrival of ions at the exit cross section of the quadrupole rod set as a function of time. By varying the mass stability limits monotonically in time, the mass-to-charge ratio of an ion can be (approximately) determined from its arrival time at the detector. In a conventional quadrupole mass spectrometer, the uncertainty in estimating of the mass-to-charge ratio from its arrival time corresponds to the width between the mass stability limits. This uncertainty can be reduced by narrowing the mass stability limits, i.e. operating the quadrupole as a narrow-band filter. In this mode, the mass resolving power of the quadrupole is enhanced as ions outside the narrow band of "stable" masses crash into the rods rather than passing through to the detector. However, the improved mass resolving power comes at the expense of sensitivity and through-put. In particular, when the stability limits are narrow, even "stable" masses are only marginally stable, and thus, only a relatively small fraction of these reach the detector.

FIG. 1A shows example data from a Triple Stage Quadrupole (TSQ) mass analyzer to illustrate mass resolving power capabilities presently available in a quadrupole device. As shown in FIG. 1A, the mass resolving power that results from the example detected m/z 508.208 ion is about 44,170, which is similar to what is typically achieved in "high resolution" platforms, such as, Fourier Transform Mass Spectrometry (FTMS). To obtain such a mass resolving power, the instrument is scanned slowly and operated within the boundaries of a predetermined mass stability region. Although the mass resolving power (i.e., the intrinsic mass resolving power) shown by the data is relatively high, the sensitivity, while not shown, is very poor for the instrument.

FIG. 1B (see inset) shows Q3 intensities of example m/z 182, 508, and 997 ions from a TSQ quadrupole operated with a narrow stability transmission window (data denoted as A) and with a wider stability transmission window (data denoted as A'). The data in FIG. 1B is utilized to show that the sensitivity for a mass selectivity quadrupole can be increased significantly by opening the transmission stability window. However, while not explicitly shown in the figure, the intrinsic mass resolving power for a quadrupole instrument operated in such a wide-band mode often is undesirable.

The key point to be taken by FIGS. 1A and 1B is that conventionally, operation of a quadrupole mass filter provides for either relatively high mass resolving power or high sensitivity at the expense of mass resolving power but not for both simultaneously and in all cases, the scan rate is relatively slow.

More recently quadrupole mass spectrometry systems have been developed that allow for the resolution of ion exit patterns at the detector. Such a system is described in U.S. Patent Application No. 2011/0215235, entitled, "QUADRUPOLE MASS SPECTROMETER WITH ENHANCED SENSITIVITY AND MASS RESOLVING POWER," published Sep. 8, 2011, by Schoen et al., the contents of which are hereby incorporated by reference. Instead of merely detecting the impact of an ion, the new systems allow for the detection of location of the impact on the detector using photo detectors and the collection of a sequence of resulting ion images in which each signal from distinct ion component can be related to a common reference signal. FIG. 2B shows an example of a detection plot displaying spatial information from the detector. The system is able to widen the band of stable ions passing through the quadrupole and can discriminate among ion species, even when both are simultaneously stable, by recording where the ions strike a position-sensitive detector as a function of the applied RF and DC fields. When the arrival times and positions are binned, the data can be thought of as a series of ion images. Each observed ion image is essentially the superposition of component images, one for each distinct m/z value exiting the quadrupole at a given time instant. Because the disclosures of Schoen et al. provides for the prediction of an arbitrary ion image as a function of m/z and the applied field, each individual component can be extracted from a sequence of observed ion images by the mathematical deconvolution processes. The mass-to-charge ratio and abundance of each species necessarily follow directly from the deconvolution.

These new approaches to resolving ion exit patterns allow for longer scans that produce larger datasets. Methods for processing these data have been described in Schoen et al. A key element in the approach described in Schoen et al. is the assumption that the reference peak, under exponential ramping of the DC/RF voltages, can be regarded as translation invariant, i.e. reference peaks of two different masses are identical except for a time translation. This assumption reduces the computational complexity of the processing step from O(N3) to O(N log N), making real time processing possible.

However, for longer scans, for example above 500 amu long, the approaches described in Schoen et al. may become inadequate. First, for long scans, even O(N log N) in complexity may become too time consuming for real time operation. Second, and more critically, the assumption of translation invariance of reference peaks may no longer be valid for long scans. One approach to address these issues is by breaking the large data set into smaller subsets of data, sometime referred to as "chunking," and process the "chunks" or subsets independently. By processing the data set in chunks the processing can be distributed to multiple compute cores, and if the chunks are sufficiently short translation invariance can be maintained to simplify the computation of each chunk.

Implementing data processing by chunking, however, is non-trivial. The first obstacle is that processing each chunk can itself be very time consuming, and result in processing multiple chunks where processing each chunk in nearly as time consuming as processing the entire data set. Further, even where processing multiple chunks is more efficient, problems can arise in the reassembling of the chunks back into a single output corresponding to the original data set. Piecing together the chunk results, each solved with a potentially different reference, is not a straightforward exercise.

Accordingly, there is a need in the field of mass spectrometry to improve the processing of large data sets. The present disclosure addresses this need, as disclosed herein, by breaking the large data sets into smaller chunks having different time references and processing those chunks such that they can be reassembled despite the differences in references.

BRIEF SUMMARY OF THE INVENTION

The disclosure is directed to a novel method or processing long scan data from a mass spectrometer, particularly long scan data generated from a sequence of time dependent ion images, such as those generated by a mass spectrometer operating in modes described in Schoen et al. The method provides for breaking the long scan data into multiple discrete subsets and padding each of the multiple subsets by adding additional strings of data on either end of the subset. The method further provides for deconvolving each of the multiple subsets and correcting for overhang errors on each deconvolved subset. A deconvolved full data set is then assembled from the deconvolved subsets.

In another aspect, a mass spectrometer is described that includes a multipole configured to pass an ion stream, the ion stream comprising an abundance of one or more ion species within stability boundaries defined by (a, q) values. A detector is configured to detect the spatial and temporal properties of the abundance of ions, and a processing system is configured to record and store a pattern of detection of ions in the abundance of ions by the dynodes in the detector. The processing system is operable to break the long scan data into multiple discrete subsets, deconvolve each of the multiple subsets, correct for overhang errors on each deconvolved subset, and assemble the deconvolved subsets into a deconvolved full data set.

In another aspect a high mass resolving power high sensitivity multipole mass spectrometer method is described. The method includes providing a reference signal and acquiring spatial and temporal raw data of an abundance of one or more ion species from an exit channel of the multipole. The acquired data is then broken into two or more chunks, which are deconvolved each with its appropriate reference signal. The method then corrects for overhang errors for each of the two or more chunks of data by computing a deconvolution of one overhang, translating and reflecting he deconvolved overhang to obtain the corresponding second overhang and then prepending the first and second deconvolved overhangs to the associated chunk of the two or more chunks of data. The fully deconvolved and overhang corrected chunks is then reassembled into a fully deconvolved data set.

The foregoing has outlined rather broadly the features and technical advantages of the present disclosure in order that the detailed description that follows may be better understood. Additional features and advantages will be described hereinafter which form the subject of the claims. It should be appreciated by those skilled in the art that the conception and specific embodiment disclosed may be readily utilized as a basis for modifying or designing other structures for carrying out the same purposes. It should also be realized by those skilled in the art that such equivalent constructions do not depart from the spirit and scope of the disclosure as set forth in the appended claims. The novel features which are believed to be characteristic of the disclosed systems and methods, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawings, in which:

FIG. 10B shows and example of a downsampled overhang from FIG. 10A.

DETAILED DESCRIPTION OF THE INVENTION

Figure 1A:
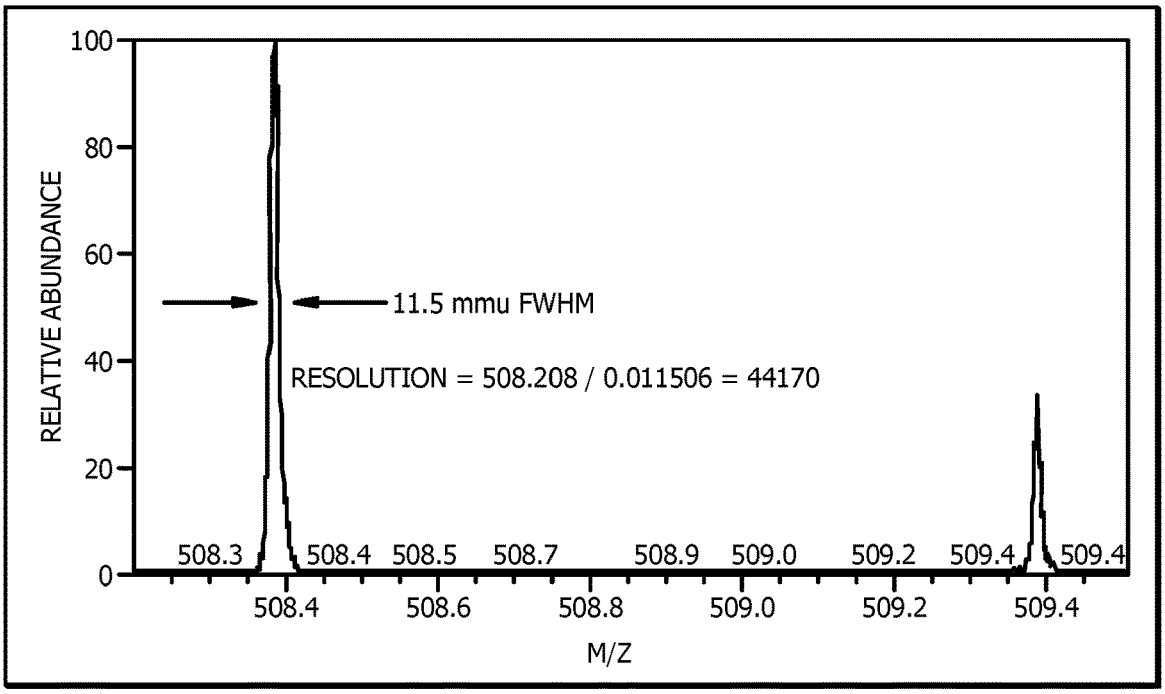
FIG. 1A shows example quadrupole mass data from a beneficial commercial TSQ.
Figure 1B:
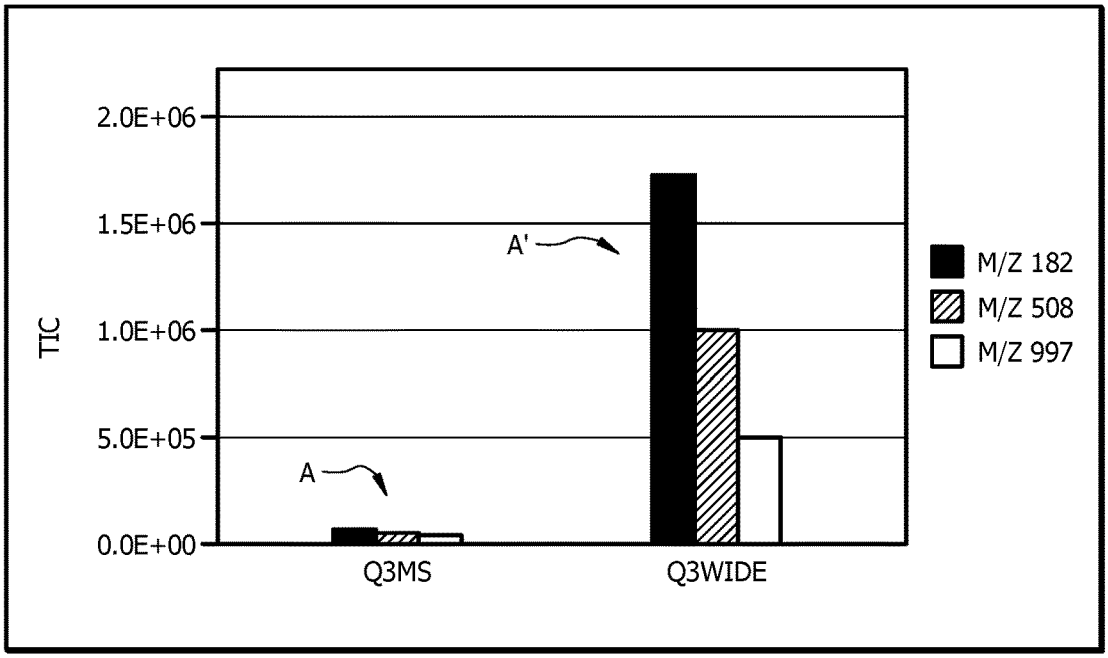
FIG. 1B shows additional Q3 data from a TSQ quadrupole operated with an AMU stability transmission window of 0.7 FWHM (A) in comparison with an AMU stability transmission window of 10.0 FWHM (A').

In the description herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the disclosure. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about."

Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

Typically, a multipole mass filter (e.g., a quadrupole mass filter) operates on a continuous ion beam although pulsed ion beams may also be used with appropriate modification of the scan function and data acquisition algorithms to properly integrate such discontinuous signals. A quadrupole field is produced within the instrument by dynamically applying electrical potentials on configured parallel rods arranged with four-fold symmetry about a long axis. The axis of symmetry is referred to as the z-axis. By convention, the four rods are described as a pair of x rods and a pair of y rods. At any instant of time, the two x rods have the same potential as each other, as do the two y rods. The potential on the y rods is inverted with respect to the x rods. Relative to the constant potential at the z-axis, the potential on each set of rods can be expressed as a constant DC offset plus an RF component that oscillates rapidly (with a typical frequency of about 1 MHz).

The DC offset on the x-rods is positive so that a positive ion feels a restoring force that tends to keep it near the z-axis; the potential in the x-direction is like a well. Conversely, the DC offset on the y-rods is negative so that a positive ion feels a repulsive force that drives it further away from the z-axis; the potential in the y-direction is like a hill. Together, the x-axis and y-axis potential form a saddle shaped potential well.

An oscillatory RF component is applied to both pairs of rods. The RF phase on the x-rods is the same and differs by 180 degrees from the phase on the y-rods. Ions move inertially along the z-axis from the entrance of the quadrupole to a detector often placed at the exit of the quadrupole. Inside the quadrupole, ions have trajectories that are separable in the x and y directions. In the x-direction, the applied RF field carries ions with the smallest mass-to-charge ratios out of the potential well and into the rods. Ions with sufficiently high mass-to-charge ratios remain trapped in the well and have stable trajectories in the x-direction, the applied field in the x-direction acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x and y pass through the quadrupole to reach the detector. The DC offset and RF amplitude can be chosen so that only ions with a desired range of m/z values are measured. If the RF and DC voltages are fixed, the ions traverse the quadrupole from the entrance to the exit and exhibit exit patterns that are a periodic function of the containing RF phase. Although where the ions exit is based upon the separable motion in the x and y axis, the observed ion oscillations are completely locked to the RF cycle. As a result of operating a quadrupole in, for example, a mass filter mode, the scanning of the device by providing ramped RF and DC voltages naturally varies the spatial characteristics with time as observed at the exit aperture of the instrument.

The disclosed systems and methods exploit such varying characteristics by collecting the spatially dispersed ions of different m/z even as they exit the quadrupole at essentially the same time. For example, as exemplified in FIG. 2B, at a given instant in time, the ions of mass A and the ions of mass B can lie in two distinct clusters in the exit cross section of the instrument. The disclosed system acquires the dispersed exiting ions with a time resolution on the order of 10 RF cycles, more often down to an RF cycle (e.g., a typical RF cycle of 1 MHz corresponds to a time frame of about 1 microsecond) or with sub RF cycle specificity to provide data in the form of one or more collected images as a function of the RF phase at each RF and/or applied DC voltage. Once collected, the disclosed systems and methods can extract the full mass spectral content in the captured image(s) via a constructed model that deconvolutes the ion exit patterns and thus provide desired ion signal intensities even while in the proximity of interfering signals.

Specific Description of Mass Filter Operation

The trajectory of ions in an ideal quadrupole is modeled by the Mathieu equation. The Mathieu equation describes a field of infinite extent both radially and axially, unlike the real situation in which the rods have a finite length and finite separation. The solutions of the Mathieu equation, as known to those skilled in the art, can be classified as bounded and non-bounded. Bounded solutions correspond to trajectories that never leave a cylinder of finite radius, where the radius depends on the ion's initial conditions. Typically, bounded solutions are equated with trajectories that carry the ion through the quadrupole to the detector. For finite rods, some ions with bounded trajectories hit the rods rather than passing through to the detector, i.e., the bound radius exceeds the radius of the quadrupole orifice. Conversely, some ions with marginally unbounded trajectories pass through the quadrupole to the detector, i.e., the ion reaches the detector before it has a chance to expand radially out to infinity. Despite these shortcomings, the Mathieu equation is still very useful for understanding the behavior of ions in a finite quadrupole.

The Mathieu equation can be expressed in terms of two unitless parameters, a and q. The general solution of the Mathieu equation, i.e., whether or not an ion has a stable trajectory, depends only upon these two parameters. The trajectory for a particular ion also depends on a set of initial conditions—the ion's position and velocity as it enters the quadrupole and the RF phase of the quadrupole at that instant. If m/z denotes the ion's mass-to-charge ratio, U denotes the DC offset, and V denotes the RF amplitude, then a is proportional to U/(m/z) and q is proportional to V/(m/z). The plane of (q, a) values can be partitioned into contiguous regions corresponding to bounded solutions and unbounded solutions. The depiction of the bounded and unbounded regions in the q-a plane is called a stability diagram, as is to be discussed in detail below with respect to FIG. 2A. The region containing bounded solutions of the Mathieu equation is called a stability region. A stability region is formed by the intersection of two regions, corresponding to regions where the x- and y-components of the trajectory are stable respectively. There are multiple stability regions, but conventional instruments involve the principal stability region. The principal stability region has a vertex at the origin of the q-a plane. Its boundary rises monotonically to an apex at a point with approximate coordinates (0.706, 0.237) and falls monotonically to form a third vertex on the a-axis at q approximately 0.908. By convention, only the positive quadrant of the q-a plane is considered. In this quadrant, the stability region resembles a triangle.

Figure 2A:
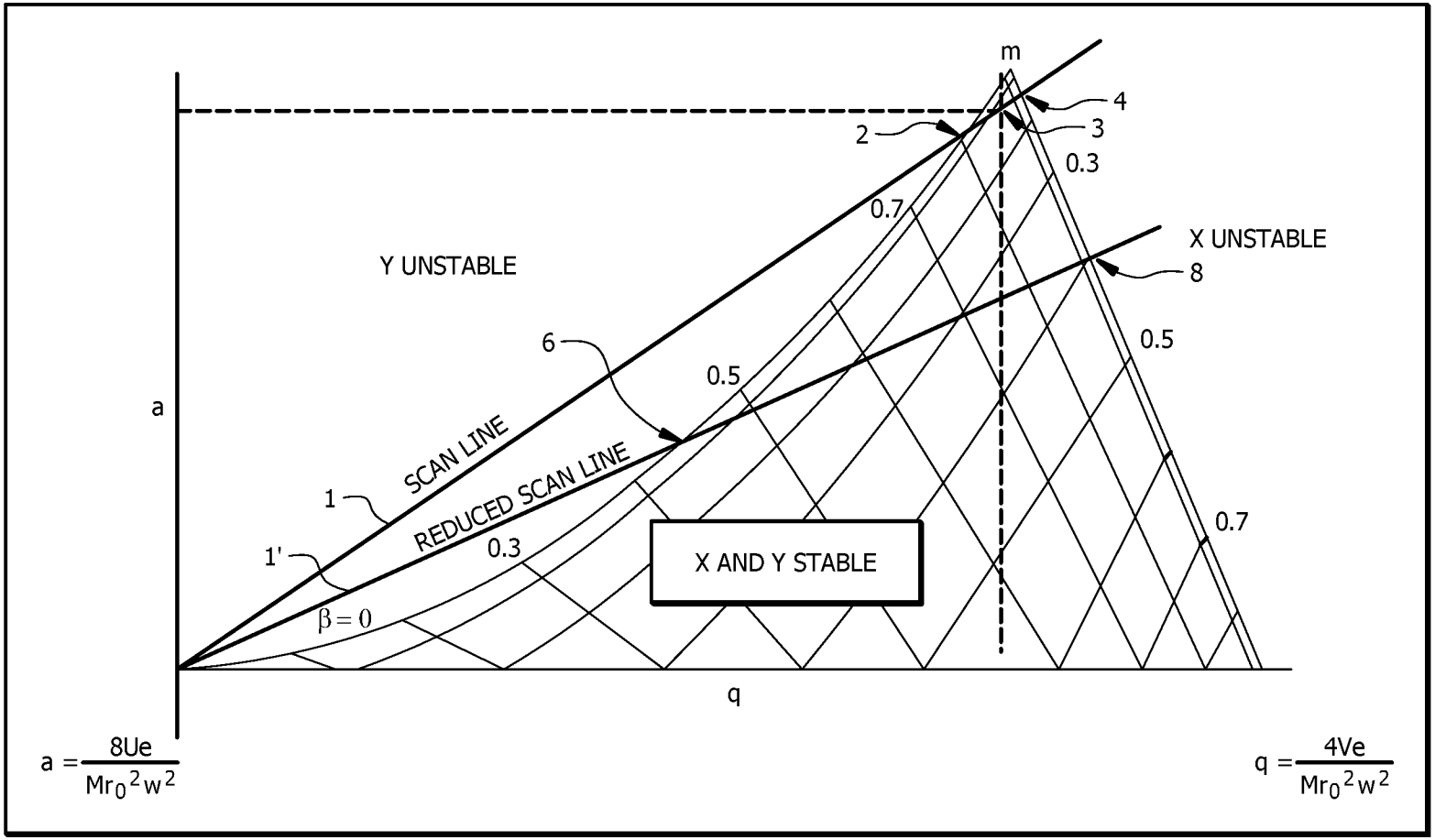
FIG. 2A shows the Mathieu stability diagram with a scan line representing narrower mass stability limits and a "reduced" scan line, in which the DC/RF ratio has been reduced to provide wider mass stability limits.

FIG. 2A shows such an example Mathieu quadrupole stability diagram for ions of a particular mass/charge ratio. For an ion to pass, it must be stable in both the X and Y dimensions simultaneously. The Y iso-beta lines ($\beta_y$), as shown in FIG. 2A, tend toward zero at the tip of the stability diagram and the X iso-beta lines ($\beta_x$) tend toward 1.0. During common operation of a quadrupole for mass filtering purposes, the q and a parameters for corresponding fixed RF and DC values, can be desirably chosen to correspond close to the apex (denoted by m) in the diagram "parked" so that substantially only m ions can be transmitted and detected. For other values of U/V ratios, ions with different m/z values map onto a line in the stability diagram passing through the origin and a second point (q*,a*) (denoted by the reference character 2). The set of values, called the operating line, as denoted by the reference character 1 shown in FIG. 2A, can be denoted by {(kq*, ka*): k>0), with k inversely proportional to m/z. The slope of the line is specified by the UN ratio. When q and a and thus proportionally applied RF and DC voltages to a quadrupole are increased at a constant ratio, the scan line 1 is configured to pass through a given stability region for an ion.

Therefore, the instrument, using the stability diagram as a guide can be "parked", i.e., operated with a fixed U and V to target a particular ion of interest, (e.g., at the apex of FIG. 2A as denoted by m) or "scanned", increasing both U and V amplitude monotonically to bring the entire range of m/z values into the stability region at successive time intervals, from low m/z to high m/z. A special case is when U and V are each ramped linearly in time. In this case, all ions progress the same fixed operating line through the stability diagram, with ions moving along the line at a rate inversely proportional to m/z. For example, if an ion of mass-to-charge ratio M passes through (q*,a*) 2 at time t, an ion with mass-to-charge 2M passes through the same point at time 2t. If (q*,a*) 2 is placed just below the tip of the stability diagram of FIG. 2A, so that mass-to-charge M is targeted at time t, then mass-to-charge ratio 2M is targeted at time 2t. Therefore, the time scale and m/z scale are linearly related. As a result, the flux of ions hitting the detector as a function of time is very nearly proportional to the mass distribution of ions in a beam. That is, the detected signal is a "mass spectrum".

To provide increased sensitivity by increasing the abundance of ions reaching the detector, the scan line 1', as shown in FIG. 2A, can be reconfigured with a reduced slope, as bounded by the regions 6 and 8. When the RF and DC voltages are ramped linearly with time, ("scanned" as stated above) every m/z value follows the same path in the Mathieu stability diagram (i.e., the q, a path) with the ions, as before, moving along the line at a rate inversely proportional to m/z.

To further appreciate ion movement with respect to the Mathieu stability diagram, it is known that an ion is unstable in the y-direction before entering the stability region but as the ion enters a first boundary 2 of the stability diagram (having a $\beta_y$=0), it becomes critically stable, with relatively large oscillations of high amplitude and low frequency in the y-direction that tend to decrease over time. As the ion exits the stability diagram as shown by the boundary region 4, it becomes unstable in the x-direction ($\beta_x$=1), and so the oscillations in the x-direction tend to increase over time, with relatively large oscillations in x just before exiting. If the scan line is operated in either the y-unstable region or the x-unstable region, ions not bounded within the stability diagram discharge against the electrodes and are not detected. Generally, if two ions are stable at the same time, the heavier one (entering the stability diagram later) has larger y-oscillations and the lighter one has larger x-oscillations.

The other aspect of ion motion that changes as the ion moves through the stability region of FIG. 2A is the frequency of oscillations in the x- and y-directions (as characterized by the Mathieu parameter beta (β)). As the ion enters the stability diagram, the frequency of its (fundamental) oscillation in the y-direction is essentially zero and rises to some exit value. The fundamental y-direction ion frequency increases like a "chirp", i.e., having a frequency increasing slightly non-linearly with time as beta increases non-linearly with the a:q ramp, as is well known in the art. Similarly, the frequency (ω) of the fundamental x-direction oscillation also increases from some initial value slightly below the RF/2 or (ω/2) up to exactly the ω/2 (β=1) at the exit. It is to be appreciated that the ion's motion in the x-direction is dominated by the sum of two different oscillations with frequencies just above and below the main (ω/2). The one just below ω/2 (i.e., the fundamental) is the mirror image of the one just above ω/2. The two frequencies meet just as the ion exits, which results in a very low frequency beating phenomenon just before the ion exits, analogous to the low frequency y-oscillations as the ion enters the stability region.

Thus, if two ions are stable at the same time, the heavier one (not as far through the stability diagram) has slower oscillations in both X and Y (slightly in X, but significantly so in Y); with the lighter one having faster oscillations and has low-frequency beats in the X-direction if it is near the exit. The frequencies and amplitudes of micromotions also change in related ways that are not easy to summarize concisely, but also help to provide mass discrimination. This complex pattern of motion is utilized in a novel fashion to distinguish two ions with very similar mass.

As a general statement of the above description, ions manipulated by a quadrupole are induced to perform an oscillatory motion "an ion dance" on the detector cross section as it passes through the stability region. Every ion does exactly the same dance, at the same "a" and "q" values, just at different RF and DC voltages at different times. The ion motion (i.e., for a cloud of ions of the same m/z but with various initial displacements and velocities) is completely characterized by a and q by influencing the position and shape cloud of ions exiting the quadrupole as a function of time. For two masses that are almost identical, the speed of their respective dances is essentially the same and can be approximately related by a time shift.

Figure 2B:
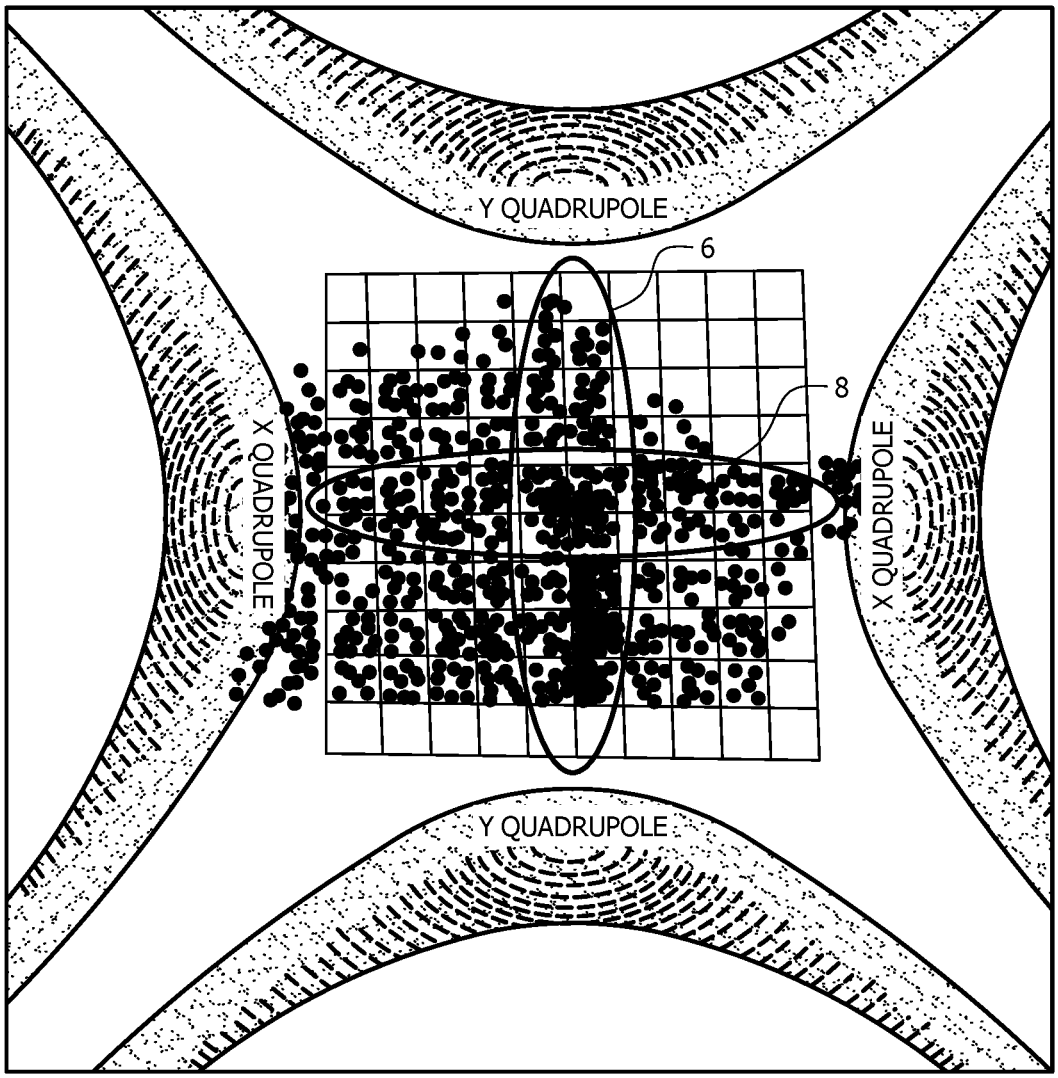
FIG. 2B shows a simulated recorded image of a multiple distinct species of ions as collected at the exit aperture of a quadrupole at a particular instant in time.

FIG. 2B shows a simulated recorded image of a particular pattern at a particular instant in time of such an "ion dance". The example image can be collected by a fast detector, (i.e., a detector capable of time resolution of 10 RF cycles, more often down to an RF cycle or with sub RF cycles specificity) as discussed herein, positioned to acquire where and when ions exit and with substantial mass resolving power to distinguish fine detail. As stated above, when an ion, at its (q, a) position, enters the stability region during a scan, the y-component of its trajectory changes from "unstable" to "stable". Watching an ion image formed in the exit cross section progress in time, the ion cloud is elongated and undergoes wild vertical oscillations that carry it beyond the top and bottom of a collected image. Gradually, the exit cloud contracts, and the amplitude of the y-component oscillations decreases. If the cloud is sufficiently compact upon entering the quadrupole, the entire cloud remains in the image, i.e. 100% transmission efficiency, during the complete oscillation cycle when the ion is well within the stability region.

As the ion approaches the exit of the stability region, a similar effect happens, but in reverse and involving the x-component rather than y. The cloud gradually elongates in the horizontal direction and the oscillations in this direction increase in magnitude until the cloud is carried across the left and right boundaries of the image. Eventually, both the oscillations and the length of the cloud increase until the transmission decreases to zero.

FIG. 2B graphically illustrates such a result. Specifically, FIG. 2B shows five masses (two shown highlighted graphically within ellipses) with stable trajectories through the quadrupole. However, at the same RF and DC voltages, each comprises a different a and q and therefore 'beta' so at every instant, a different exit pattern.

In particular, the vertical cloud of ions, as enclosed graphically by the ellipse 6 shown in FIG. 2B, correspond to the heavier ions entering the stability diagram, as described above, and accordingly oscillate with an amplitude that brings such heavy ions close to the denoted Y quadrupoles. The cluster of ions enclosed graphically by the ellipse 8 shown in FIG. 2B correspond to lighter ions exiting the stability diagram, as also described above, and thus cause such ions to oscillate with an amplitude that brings such lighter ions close to the denoted X quadrupoles. Within the image lie the additional clusters of ions (shown in FIG. 2B but not specifically highlighted) that have been collected at the same time frame but which have a different exit pattern because of the differences of their a and q and thus 'beta' parameters.

Every exit cloud of ions thus performs the same "dance", oscillating wildly in y as it enters the stability region and appears in the image, settling down, and then oscillating wildly in x as it exits the stability diagram and disappears from the image. Even though all ions do the same dance, the timing and the tempo vary. The time when each ion begins its dance, i.e. enters the stability region, and the rate of the dance, are scaled by $(m/z)^{-1}$.

As can be seen from FIG. 2B, the majority of spatial information is contained in the ion's location along the x-axis or y-axis when it hits the detector. By determining if an ion hits the center, y+, y−, x+ or x− detector, information about that ion can be deduced. Heavier ions will primarily enter the y+ and y− detectors while lighter ions will primarily enter the x+ and x− detectors. Ions with intermediate mass will not have large oscillations in either direction and will therefore primarily enter the center detector.

A key point is that merely classifying ion trajectories as bounded versus unbounded does not harness the full potential of a quadrupole to distinguish ions with similar mass-to-charge ratios. Finer distinctions can be made among ions with bounded trajectories by recording which detector the ions enter as a function of the applied fields. The Schoen et al. disclosure demonstrates the ability to distinguish the m/z values of ions that are simultaneously stable in the quadrupole by recording the times and positions of when the ions arrive at the detector. Leveraging this ability can have a profound impact upon the sensitivity of a quadrupole mass spectrometer. Because only ions with bounded trajectories are measured, it necessarily follows that the signal-to-noise characteristic of any ion species improves with the number of ions that actually reach the detector.

The stability transmission window for a quadrupole, such as one described by Schoen et al., can thus be configured in a predetermined manner (i.e., by reducing the slope of the scan line 1', as shown in FIG. 2A) to allow a relatively broad range of ions to pass through the instrument, the result of which increases the signal-to-noise because the number of ions recorded for a given species is increased. Accordingly, by increasing the number of ions, a gain in sensitivity is beneficially provided because at a given instant of time a larger fraction of a given species of ions can now not only pass through the quadrupole but also pass through the quadrupole for a much longer duration of the scan. The potential gain in sensitivity necessarily follows by the multiplicative product of these factors.

However, while the increase in ion counts is necessary, there are certain tradeoffs that may be required for increased sensitivity. As an example, when a quadrupole is operated as a mass-filter with improved ion statistics, i.e., by opening the transmission stability window, a gain in sensitivity can be compromised by a loss in mass resolving power because the low-abundance species within the window may be obscured by one of higher abundance that is exiting the quadrupole in the same time frame. To mitigate such an effect, it is to be appreciated that while the mass resolving power is potentially substantially large (i.e., by operating with RF-only mode), often the system is operated with a mass resolving power window of up to about 10 AMU wide and in some applications, up to about 20 AMU in width in combination with scan rates necessary to provide for useful signal to noise ratios within the chosen m/z transmission window.

Using spatial information as a basis for separation enables the disclosed methods and instruments to provide not only high sensitivity, (i.e., an increased sensitivity 10 to 200 times greater than a conventional quadrupole filter) but to also simultaneously provide for differentiation of mass deltas of 1,000 ppm (a mass resolving power of one thousand) down to about 10 ppm (a mass resolving power of 100 thousand). Unexpectedly, the disclosed systems and methods can even provide for an unparalleled mass delta differentiation of 1 ppm (i.e., a mass resolving power of 1 million) if the devices disclosed herein are operated under ideal conditions that include minimal drift of all electronics.

Figure 3:
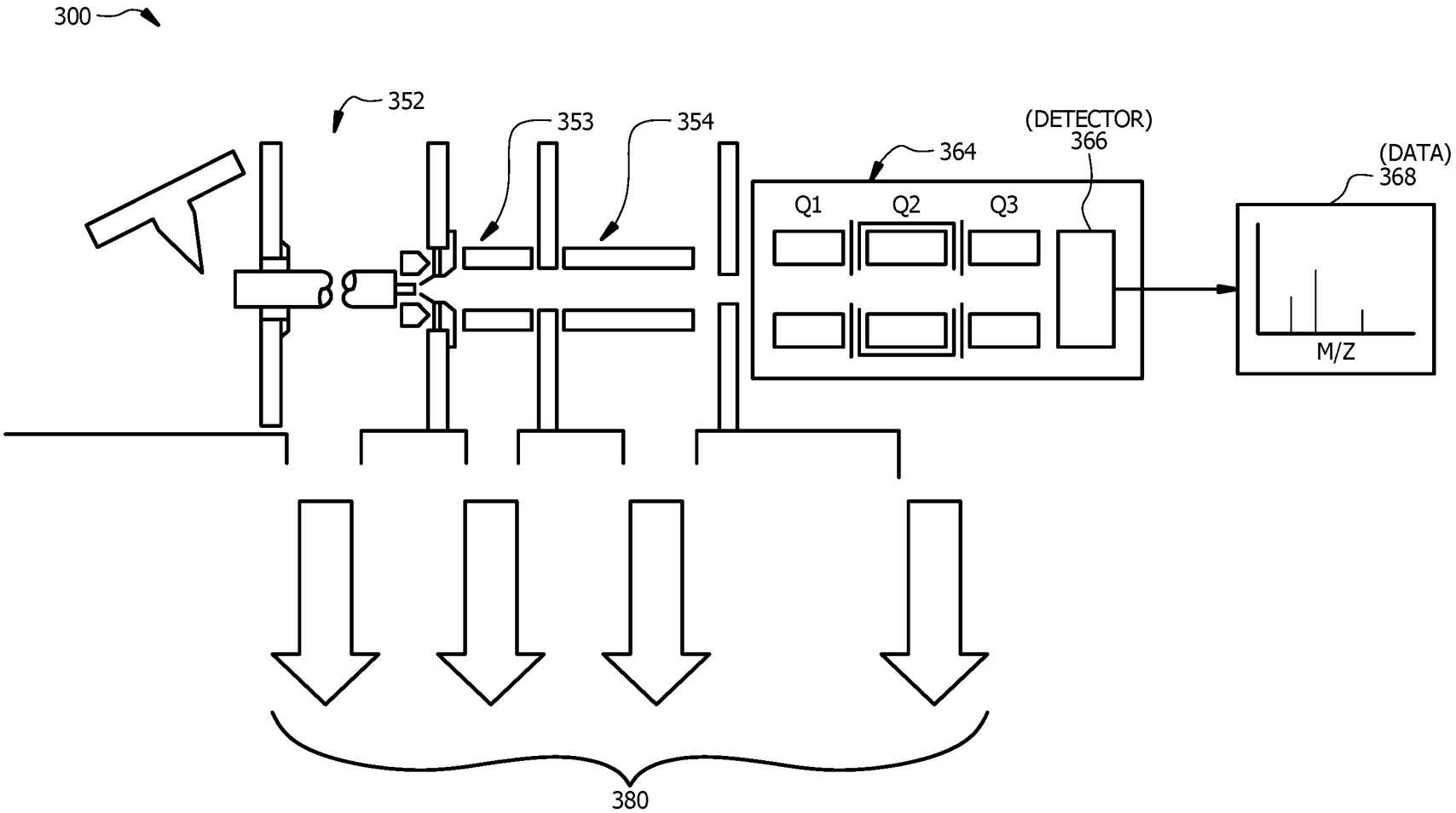
FIG. 3 shows a beneficial example configuration of a triple stage mass spectrometer system that can be operated with the disclosed methods.

Referring now to FIG. 3, a beneficial example configuration of a triple stage mass spectrometer system (e.g., a commercial TSQ) is shown generally designated by the reference numeral 300. It is to be appreciated that mass spectrometer system 300 is presented by way of a non-limiting beneficial example and thus the disclosed methods may also be practiced in connection with other mass spectrometer systems having architectures and configurations different from those depicted herein.

The operation of mass spectrometer 300 can be controlled and data can be acquired by a control and data system (not depicted) of various circuitry of a known type, which may be implemented as any one or a combination of general or special-purpose processors (digital signal processor (DSP)), firmware, software to provide instrument control and data analysis for mass spectrometers and/or related instruments, and hardware circuitry configured to execute a set of instructions that embody the prescribed data analysis and control routines. Such processing of the data may also include averaging, scan grouping, deconvolution as disclosed herein, library searches, data storage, and data reporting.

It is also to be appreciated that instructions to start predetermined slower or faster scans as disclosed herein, the identifying of a set of m/z values within the raw file from a corresponding scan, the merging of data, the exporting/displaying/outputting to a user of results, etc., may be executed via a data processing based system (e.g., a controller, a computer, a personal computer, etc.), which includes hardware and software logic for performing the aforementioned instructions and control functions of the mass spectrometer 300.

In addition, such instruction and control functions, as described above, can also be implemented by a mass spectrometer system 300, as shown in FIG. 3, as provided by a machine-readable medium (e.g., a computer readable medium). A computer-readable medium, in accordance with aspects of the present disclosure, refers to mediums known and understood by those of ordinary skill in the art, which have encoded information provided in a form that can be read (i.e., scanned/sensed) by a machine/computer and interpreted by the machine's/computer's hardware and/or software.

Thus, as mass spectral data of a given spectrum is received by a beneficial mass spectrometer 300 system disclosed herein, the information embedded in a computer program can be utilized, for example, to extract data from the mass spectral data, which corresponds to a selected set of mass-to-charge ratios. In addition, the information embedded in a computer program can be utilized to carry out methods for normalizing, shifting data, or extracting unwanted data from a raw file in a manner that is understood and desired by those of ordinary skill in the art.

Turning back to the example mass spectrometer 300 system of FIG. 3, a sample containing one or more analytes of interest can be ionized via an ion source 352. A multipole can be operated either in the radio frequency (RF)-only mode or an RF/DC mode. Depending upon the particular applied RF and DC potentials, only ions of selected charge to mass ratios are allowed to pass through such structures with the remaining ions following unstable trajectories leading to escape from the applied multipole field. When only an RF voltage is applied between predetermined electrodes (e.g., spherical, hyperbolic, flat electrode pairs, etc.), the apparatus is operated to transmit ions in a wide-open fashion above some threshold mass. When a combination of RF and DC voltages is applied between predetermined rod pairs there is both an upper cutoff mass as well as a lower cutoff mass. As the ratio of DC to RF voltage increases, the transmission band of ion masses narrows so as to provide for mass filter operation, as known and as understood by those skilled in the art.

Accordingly, the RF and DC voltages applied to predetermined opposing electrodes of the multipole devices, as shown in FIG. 3 (e.g., Q3), can be applied in a manner to provide for a predetermined stability transmission window designed to enable a larger transmission of ions to be directed through the instrument, collected at the exit aperture and processed so as to determined mass characteristics.

An example multipole, e.g., Q3 of FIG. 3, can thus be configured along with the collaborative components of a system 300 to provide a mass resolving power of potentially up to about 1 million with a quantitative increase of sensitivity of up to about 200 times as opposed to when utilizing typical quadrupole scanning techniques. In particular, the RF and DC voltages of such devices can be scanned over time to interrogate stability transmission windows over predetermined m/z values (e.g., 20 AMU). Thereafter, the ions having a stable trajectory reach a detector 366 capable of time resolution on the order of 10 RF cycles, or IRF cycle, or multiple times per RF cycle at a pressure as defined by the system requirements. Accordingly, the ion source 352 can include, but is not strictly limited to, an Electron Ionization (EI) source, a Chemical Ionization (CI) source, a photoionization source, a Matrix-Assisted Laser Desorption Ionization (MALDI) source, an Electrospray Ionization (ESI) source, an Atmospheric Pressure Chemical Ionization (APCI) source, an atmospheric pressure photoionization (APPI) source, a Nanoelectrospray Ionization (NanoESI) source, and an Atmospheric Pressure Ionization (API), etc.

The resultant ions are directed via predetermined ion optics that often can include tube lenses, skimmers, and multipoles, e.g., reference characters 353 and 354, selected from radio-frequency RF quadrupole and octopole ion guides, etc., so as to be urged through a series of chambers of progressively reduced pressure that operationally guide and focus such ions to provide good transmission efficiencies. The various chambers communicate with corresponding ports 380 (represented as arrows in the figure) that are coupled to a set of pumps (not shown) to maintain the pressures at the desired values.

The example spectrometer 300 of FIG. 3 is shown illustrated to include a triple stage configuration 364 having sections labeled Q, Q2 and Q3 electrically coupled to respective power supplies (not shown) so as to perform as a quadrupole ion guide that can also be operated under the presence of higher order multipole fields (e.g., an octopole field) as known to those of ordinary skill in the art. It is to be noted that such pole structures of the present more, more often down to an RF cycle or with sub RF cycles specificity, wherein the specificity is chosen to provide appropriate resolution relative to the scan rate to provide desired mass differentiation. Such a detector is beneficially placed at the channel exit of the quadrupole (e.g., Q3 of FIG. 3) to provide data that can be deconvoluted into a rich mass spectrum 368. The resulting time-dependent data resulting from such an operation is converted into a mass spectrum by applying deconvolution methods described herein that convert the collection of recorded ion arrival times and positions into a set of m/z values and relative abundances.

A simplistic configuration to observe such varying characteristics with time can be in the form of a narrow means (e.g., a pinhole) spatially configured along a plane between the exit aperture of the quadrupole (Q3) and a respective detector 366 designed to record the allowed ion information. By way of such an arrangement, the time-dependent ion current passing through the narrow aperture provides for a sample of the envelope at a given position in the beam cross section as a function of the ramped voltages. Importantly, because the envelope for a given m/z value and ramp voltage is approximately the same as an envelope for a slightly different m/z value and a shifted ramp voltage, the time-dependent ion currents passing through such an example narrow aperture for two ions with slightly different m/z values are also related by a time shift, corresponding to the shift in the RF and DC voltages. The appearance of ions in the exit cross section of the quadrupole depends upon time because the RF and DC fields depend upon time. In particular, because the RF and DC fields are controlled by the user, and therefore known, the time-series of ion images can be beneficially modeled using the solution of the well-known Mathieu equation for an ion of arbitrary m/z.

However, while the utilization of a narrow aperture at a predetermined exit spatial position of a quadrupole device illustrates the basic idea, there are in effect multiple narrow aperture positions at a predetermined spatial plane at the exit aperture of a quadrupole as correlated with time, each with different detail and signal intensity. To beneficially record such information, the spatial/temporal detector 366 configurations are in effect somewhat of a multiple pinhole array that essentially provides multiple channels of resolution to spatially record the individual shifting patterns as images that have the embedded mass content. The applied DC voltage and RF amplitude can be stepped synchronously with the RF phase to provide measurements of the ion images for arbitrary field conditions. The applied fields determine the appearance of the image for an arbitrary ion (dependent upon its m/z value) in a way that is predictable and deterministic. By changing the applied fields, the disclosed systems and methods can obtain information about the entire mass range of the sample.

As a side note, there are field components that can disturb the initial ion density as a function of position in the cross section at a configured quadrupole opening as well as the ions' initial velocity if left unchecked. For example, the field termination at an instrument's entrance, e.g., Q3's, often includes an axial field component that depends upon ion injection. As ions enter, the RF phase at which they enter effects the initial displacement of the entrance phase space, or of the ion's initial conditions. Because the kinetic energy and mass of the ion determines its velocity and therefore the time the ion resides in the quadrupole, this resultant time determines the shift between the ion's initial and exit RF phase. Thus, a small change in the energy alters this relationship and therefore the exit image as a function of overall RF phase. Moreover, there is an axial component to the exit field that also can perturb the image. While somewhat deleterious if left unchecked, the disclosed systems and methods can be configured to mitigate such components by, for example, cooling the ions in a multipole, e.g., the collision cell Q2 shown in FIG. 3, and injecting them on axis or preferably slightly off-center by phase modulating the ions within the device. The direct observation of a reference signal, i.e. a time series of images, rather than direct solution of the Mathieu equation, allows us to account for a variety of non-idealities in the field. The Mathieu equation can be used to convert a reference signal for a known m/z value into a family of reference signals for a range of m/z values. This technique provides the method with tolerance to non-idealities in the applied field.

The Effect of Ramp Speed

As discussed above, as the RF and DC amplitudes are ramped linearly in time, the a,q values for each ion each increase linearly with time, as shown above in FIG. 2A. Alternatively, the RF and DC amplitudes can be ramped exponentially with mass, such that the scan rate is proportional to the mass. Specifically, the ions in traversing the length of a quadrupole undergo a number of RF cycles during this changing condition and as a consequence, such ions experience a changing beta during the ramping of the applied voltages. Accordingly, the exit position for the ions after a period of time change as a function of the ramp speed in addition to other aforementioned factors. Moreover, in a conventional selective mass filter operation, the peak shape is negatively affected by ramp speed because the filter's window at unit mass resolving power shrinks substantially and the high and low mass cutoffs become smeared. A user of a conventional quadrupole system in wanting to provide selective scanning (e.g., unit mass resolving power) of a particular desired mass often configures his or her system with chosen a:q parameters and then scans at a predetermined discrete rate, e.g., a scan rate at about 500 (AMU/sec) to detect the signals.

However, while such a scan rate and even slower scan rates can also be utilized herein to increase desired signal to noise ratios, the disclosed systems and methods can also optionally increase the scan velocity up to about 10,000 AMU/sec and even up to about 100,000 AMU/sec as an upper limit because of the wider stability transmission windows and thus the broader range of ions that enable an increased quantitative sensitivity. Benefits of increased scan velocities include decreased measurement time frames, as well as operating the disclosed system in cooperation with survey scans, wherein the a:q points can be selected to extract additional information from only those regions (i.e., a target scan) where the signal exists so as to also increase the overall speed of operation.

General Discussion of the Data Processing

The disclosed systems and methods are thus designed to express an observed signal as a linear combination of a mixture of reference signals. In this case, the observed "signal" is the time series of acquired images of ions exiting the quadrupole. The reference signals are the contributions to the observed signal from ions with different m/z values. The coefficients in the linear combination correspond to a mass spectrum.

Reference Signals:

To construct the mass spectrum, it is beneficial to specify, for each m/z value, the signal, the time series of ion images that can be produced by a single species of ions with that m/z value. The approach herein is to construct a canonical reference signal, offline as a calibration step, by observing a test sample and then to express a family of reference signals, indexed by m/z value, in terms of the canonical reference signal.

At a given time, the observed exit cloud image depends upon three parameters-a and q and also the RF phase as the ions enter the quadrupole. The exit cloud also depends upon the distribution of ion velocities and radial displacements, with this distribution being assumed to be invariant with time, except for intensity scaling.

The construction of the family of reference signals presents a challenge. Two of three parameters, a and q, that determine the signal depend upon the ratio t/(m/z), but the third parameter depends only on t, not on m/z. Therefore, there is no way simple way to precisely relate the time-series from a pair of ions with arbitrary distinct m/z values.

Fortunately, a countable (rather than continuous) family of reference signals can be constructed from a canonical reference signal by time shifts that are integer multiples of the RF cycle. These signals are good approximations of the expected signals for various ion species, especially when the m/z difference from the canonical signal is small.

To understand why the time-shift approximation works and to explore its limitations, consider the case of two pulses centered at $t_1$ and $t_2$ respectively and with widths of $d_1$ and $d_2$ respectively, where $t_2=kt_1$, $d_2=kt_2$, and $t_1>>d_1$. Further, assume that k is approximately 1. The second pulse can be produced from the first pulse exactly by a dilation of the time axis by factor k. However, applying a time shift of $t_2$-$t_1$ to the first pulse would produce a pulse centered at $t_2$ with a width of $d_1$, which is approximately equal to $d_2$ when k is approximately one. For low to moderate stability limits (e.g. 10 Da or less), the ion signals are like the pulse signals above, narrow and centered many peak widths from time zero.

Because the ion images are modulated by a fixed RF cycle, the canonical reference signal cannot be related to the signal from arbitrary m/z value by a time shift; rather, it can only be related to signals by time shifts that are integer multiples of the RF period. That is, the RF phase aligns only at integer multiples of the RF period.

The restriction that we can only consider discrete time shifts is not a serious limitation of the disclosed systems and methods. Even in Fourier Transform Mass Spectrometry (FTMS), where the family of reference signals is valid on the frequency continuum, the observed signal is actually expressed in terms of a countable number of sinusoids whose frequencies are integer multiples of 1/T, where T is the duration of the observed signal. In both FTMS and the disclosed methods, expressing a signal that does not lie exactly on an integer multiple, where a reference signal is defined, results in small errors in the constructed mass spectrum. However, these errors are, in general, acceptably small. In both FTMS and in the disclosed methods, the m/z spacing of the reference signals can be reduced by reducing the scan rate. Unlike FTMS, a reduced scan rate in embodiments does not necessarily mean a longer scan; rather, a small region of the mass range can be quickly targeted for a closer look at a slower scan rate.

Returning to the deconvolution problem stated above, it is assumed that the observed signal is the linear combination of reference signals, and it is also assumed that there is one reference signal at integer multiples of the RF period, corresponding to regularly spaced intervals of m/z. The m/z spacing corresponding to an RF cycle is determined by the scan rate.

Matrix equation: The construction of a mass spectrum via embodiments is conceptually the same as in FTMS. In both FTMS and as utilized herein, the sample values of the mass spectrum are the components of a vector that solves a linear matrix equation: Ax=b, as discussed in detail above. Matrix A is formed by the set of overlap sums between pairs of reference signals. Vector b is formed by the set of overlap sums between each reference signal and the observed signal. Vector x contains the set of (estimated) relative abundances. Another solution to the deconvolution problem can use nonnegative deconvolution and convex optimization, as is described in U.S. Patent Application Publication No. 20150311050, the entirety of which is hereby incorporated by reference.

Matrix equation solution: In FTMS, matrix A is the identity matrix, leaving x=b, where b is the Fourier transform of the signal. The Fourier transform is simply the collection of overlap sums with sinusoids of varying frequencies. In embodiments, matrix A is often in a Toeplitz form, as discussed above, meaning that all elements in any band parallel to the main diagonal are the same. The Toeplitz form arises whenever the reference signals in an expansion are shifted versions of each other.

Computational complexity: Let N be denote the number of time samples or RF cycles in the acquisition. In general, the solution of Ax=b has $O(N^3)$ complexity, the computation of the inverse of A is $O(N^3)$ and the computation of b is $O(N^2)$. Therefore, the computation of x for the general deconvolution problem is O(N). In FTMS, A is constant, the computation of b is O(N log N) using the Fast Fourier Transform. Because Ax=b has a trivial solution, the computation is O(N log N). In embodiments, the computation of A is $O(N^2)$ because only 2N−1 unique values need to be calculated, the computation of B is $O(N^2)$, and the solution of Ax=b is $O(N^2)$ when A is a Toeplitz form. Therefore, the computation of x—the mass spectrum—is $O(N^2)$.

The reduced complexity, from $O(N^3)$ to $O(N^2)$ is beneficial for constructing a mass spectrum in real-time. The computations are highly parallelizable and can be implemented on an imbedded GPU. Another way to reduce the computational burden is to break the acquisition into smaller time intervals or "chunks". The solution of k chunks of size N/k results in a k-fold speed-up for an $O(N^2)$ problem. "Chunking" also addresses the problem that the time-shift approximation for specifying reference signals may not be valid for m/z values significantly different from the canonical reference signal.

Further Performance Analysis Discussion

The key metrics for assessing the performance of a mass spectrometer are sensitivity, mass resolving power, and the scan rate. As previously stated, sensitivity refers to the lowest abundance at which an ion species can be detected in the proximity of an interfering species. MRP is defined as the ratio M/DM, where M is the m/z value analyzed and DM is usually defined as the full width of the peak in m/z units, measured at half-maximum (i.e. FWHM). An alternative definition for DM is the smallest separation in m/z for which two ions can be identified as distinct. This alternative definition is most useful to the end user, but often difficult to determine.

In the description of Schoen et al., the user can control the scan rate and the DC/RF amplitude ratio. By varying these two parameters, users can trade-off scan rate, sensitivity, and MRP, as described below. The performance of the system is also enhanced when the entrance beam is focused, providing greater discrimination. Further improvement, as previously stated, can be achieved by displacing a focused beam slightly off-center as it enters the quadrupole. When the ions enter off-center, the exit ion cloud undergoes larger oscillations, leading to better discrimination of closely related signals. However, it is to be noted that if the beam is too far off-center, fewer ions reach the detector resulting in a loss of sensitivity.

Scan Rate:

Scan rate is typically expressed in terms of mass per unit time, but this is only approximately correct. As U and V are ramped, increasing m/z values are swept through the point (q*,a*) lying on the operating line, as shown above in FIG. 2A. When U and V are ramped linearly in time, the value of m/z seen at the point (q*,a*) changes linearly in time, and so the constant rate of change can be referred to as the scan rate in units of Da/s. However, each point on the operating line has a different scan rate. When the mass stability limit is relatively narrow, m/z values sweep through all stable points in the operating line at roughly the same rate.

Sensitivity:

Fundamentally, the sensitivity of a quadrupole mass spectrometer is governed by the number of ions reaching the detector. When the quadrupole is scanned, the number of ions of a given species that reach the detector is determined by the product of the source brightness, the average transmission efficiency and the transmission duration of that ion species. The sensitivity can be improved, as discussed above, by reducing the DC/RF line away from the tip of the stability diagram. The average transmission efficiency increases when the DC/RF ratio because the ion spends more of its time in the interior of the stability region, away from the edges where the transmission efficiency is poor. Because the mass stability limits are wider, it takes longer for each ion to sweep through the stability region, increasing the duration of time that the ion passes through to the detector for collection.

Duty Cycle:

When acquiring a full spectrum, at any instant, only a fraction of the ions created in the source are reaching the detector; the rest are hitting the rods. The fraction of transmitted ions, for a given m/z value, is called the duty cycle. Duty cycle is a measure of efficiency of the mass spectrometer in capturing the limited source brightness. When the duty cycle is improved, the same level of sensitivity can be achieved in a shorter time, i.e. higher scan rate, thereby improving sample throughput. In a conventional system as well as the present disclosure, the duty cycle is the ratio of the mass stability range to the total mass range present in the sample.

By way of a non-limiting example to illustrate an improved duty cycle by use of the methods herein, a user of the system and method described herein can, instead of 1 Da (typical of a conventional system), choose stability limits (i.e., a stability transmission window) of 10 Da (as provided herein) so as to improve the duty cycle by a factor of 10. A source brightness of $10^9$/s is also configured for purposes of illustration with a mass distribution roughly uniform from 0 to 1000, so that a 10 Da window represents 1% of the ions. Therefore, the duty cycle improves from 0.1% to 1%. If the average ion transmission efficiency improves from 25% to nearly 100%, then the ion intensity averaged over a full scan increases 40-fold from $10^9/s*10^{-3}*0.25=2.5*10^5$ to $10^9/s*10^{-2}*1=10^7/s$.

Therefore, suppose a user of the system and method described herein desires to record 10 ions of an analyte in full-scan mode, wherein the analyte has an abundance of 1 ppm in a sample and the analyte is enriched by a factor of 100 using, for example, chromatography (e.g., 30-second wide elution profiles in a 50-minute gradient). The intensity of analyte ions in a conventional system using the numbers above is $2.5*10^5*10^6*10^2=250/s$. So the required acquisition time in this example is about 40 ms. In the present disclosure, the ion intensity is about 40 times greater when using an example 10 Da transmission window, so the required acquisition time in the system described herein is at a remarkable scan rate of about 1 ms.

Accordingly, it is to be appreciated the beneficial sensitivity gain of the system described herein, as opposed to a conventional system, comes from pushing the operating line downward away from the tip of the stability region, as discussed throughout above, and thus widening the stability limits. In practice, the operating line can be configured to go down as far as possible to the extent that a user can still resolve a time shift of one RF cycle. In this case, there is no loss of mass resolving power; it achieves the quantum limit.

As described above, the system described herein can resolve time-shifts along the operating line to the nearest RF cycle. This RF cycle limit establishes the tradeoff between scan rate and MRP, but does not place an absolute limit on MRP and mass precision. The scan rate can be decreased so that a time shift of one RF cycle along the operating line corresponds to an arbitrarily small mass difference.

For example, suppose that the RF frequency is at about 1 MHz. Then, one RF period is 1 us. For a scan rate of 10 kDa/s, 10 mDa of m/z range sweeps through a point on the operating line. The ability to resolve a mass difference of 10 mDa corresponds to a MRP of 100k at m/z 1000. For a mass range of 1000 Da, scanning at 10 kDa/s produces a mass spectrum in 100 ms, corresponding to a 10 Hz repeat rate, excluding interscan overhead. Similarly, the present disclosure can trade off a factor of x in scan rate for a factor of x in MRP. Accordingly, the present disclosure can be configured to operate at 100k MRP at 10 Hz repeat rate, "slow" scans at 1M MRP at 1 Hz repeat rate, or "fast" scans at 10k MRP at 100 Hz repeat rate. In practice, the range of achievable scan speeds may be limited by other considerations such as sensitivity or electronic stability.

Analyzing a Data Set by Chunking

According to the description herein, a novel system and method of analyzing mass spectrometer data is described. Data is analyzed by breaking long data sets into subsets, or chunks. Normally, when deconvolving data sets in chunks, ringing at the boundaries of each chunk can introduce errors into the deconvolution results when the chunks are recombined into a complete solution set. The system and method described herein address various issues with analyzing data sets in chunks, including the problem with ringing at data set boundaries.

First, consider a simple case of a long scan with a translation invariance reference, i.e., reference peaks of two different masses are identical except for a time translation. The general goal of much of mass spectroscopy, stated mathematically, is to solve the linear system of equation:

$$\sum_i I_i U_i = S \qquad \text{eq. 1}$$

$U_i$ represents the reference signal of a chemical species corresponding to a particular m/z, indexed by i. S is the resultant observed signal in totality. And $I_i$, the amount or abundance of the species at the i-th m/z, is what we would like to solve for. Each reference signal, or simply reference, is a profile over a time-ordered set of voxels. Each voxel itself consists of 3 dimensions (x,y,p)—x, y, the horizontal and vertical pixel positions on the detector and p, the phase of the RF voltage. The total signal S is thus a linear combination of profiles from each individual reference. To solve for the coefficients $I_i$, one can compute the inner product of the equation with U to arrive at a one dimensional linear equation:

$$\sum_i \langle U_i \mid U_j \rangle I_i = \langle S \mid U_j \rangle \quad \text{eq. 2}$$

where <X|Y> denotes the inner product between X and Y, which is defined as $$\sum_{x,y,p} X(x, y, p) * Y(x, y, p),$$

with * representing the correlation operation over t. Defining the matrix $A_{ij}$ as $<U_i|U_j>$, $b_j=<S|U_j>$ and renaming $I_i$ as $x_i$, eq. 2 takes on the familiar linear algebraic form:

$$\sum_j A_{ij} x_j = b_i \quad \text{eq. 3}$$

Eq. 3 can be solved formally by inverting the A matrix. However, this straight matrix inversion is very compute intensive (O(N3) in complexity).

Under the assumption of translation invariance, however, an additional simplification can be introduced allowing for a more efficient solution of eq. 3. When the DC and RF voltages are 'ramped' exponentially over time, the reference voxel sets are invariant: references of different m/z differ from each other only by a shift in time. This invariance is captured more precisely by $$A_{ij}=<U_i|U_j>=A(|i-j|) \quad \text{eq. 4}$$

The $A_{ij}$ matrix depends only on the absolute difference between the indices i and j. Such a matrix is known as a 'Toeplitz' matrix, which admits a O(N2) inversion algorithm, as opposed to an O(N3) one in the general case. The computational complexity can be further reduced by assuming that $A_{ij}$ is non-vanishing only over a finite range in either index i or j. This assumption is satisfied in relevant data sets since the reference $U_i$ itself is only non-vanishing over a finite range. Under this assumption (and with sufficient padding of $b_i$), $A_{ij}$ becomes a circulant matrix—the information of $A_{ij}$ is completely encoded in a 1 dimensional vector:

$$A_{ij}=c_k, \text{ where } k=|i-j| \quad \text{eq. 5}$$

The matrix multiplication in eq. 3 simplifies to a simple convolution.

$$\sum_k c_k x_{i-k} = b_i \quad \text{eq. 6}$$

The deconvolution solution via Fourier Transform is well known where FT and IFT are the Fourier and inverse Fourier transforms respectively.

$$x=IFT(FT(b)/FT(c)) \quad \text{eq. 7}$$

Using a standard FFT algorithm further reduces the complexity of eq 7 to just O(N log N) from the original O(N3) of eq. 3. However, further simplification is needed for efficient real time processing. In relevant implementations, eq. 7 is embedded within an iteratively loop for noise removal—for example, the nonnegative deconvolution via convex optimization described in U.S. Patent Application Publication No. 20150311050. Typically, the loop is iterated many times (in the order of 1000). For even a moderately sized $b_i$, an O(N log N) step will make the data processing too unwieldy for real time operation.

To reduce the complexity of solving eq. 6, the present disclosure begins with the step of breaking up eq. 6 linearly into 'chunks'. More precisely, the b vector is the decomposed as a sum:

$$b = \sum_\alpha d_\alpha \quad \text{eq. 8}$$

Figure 4:
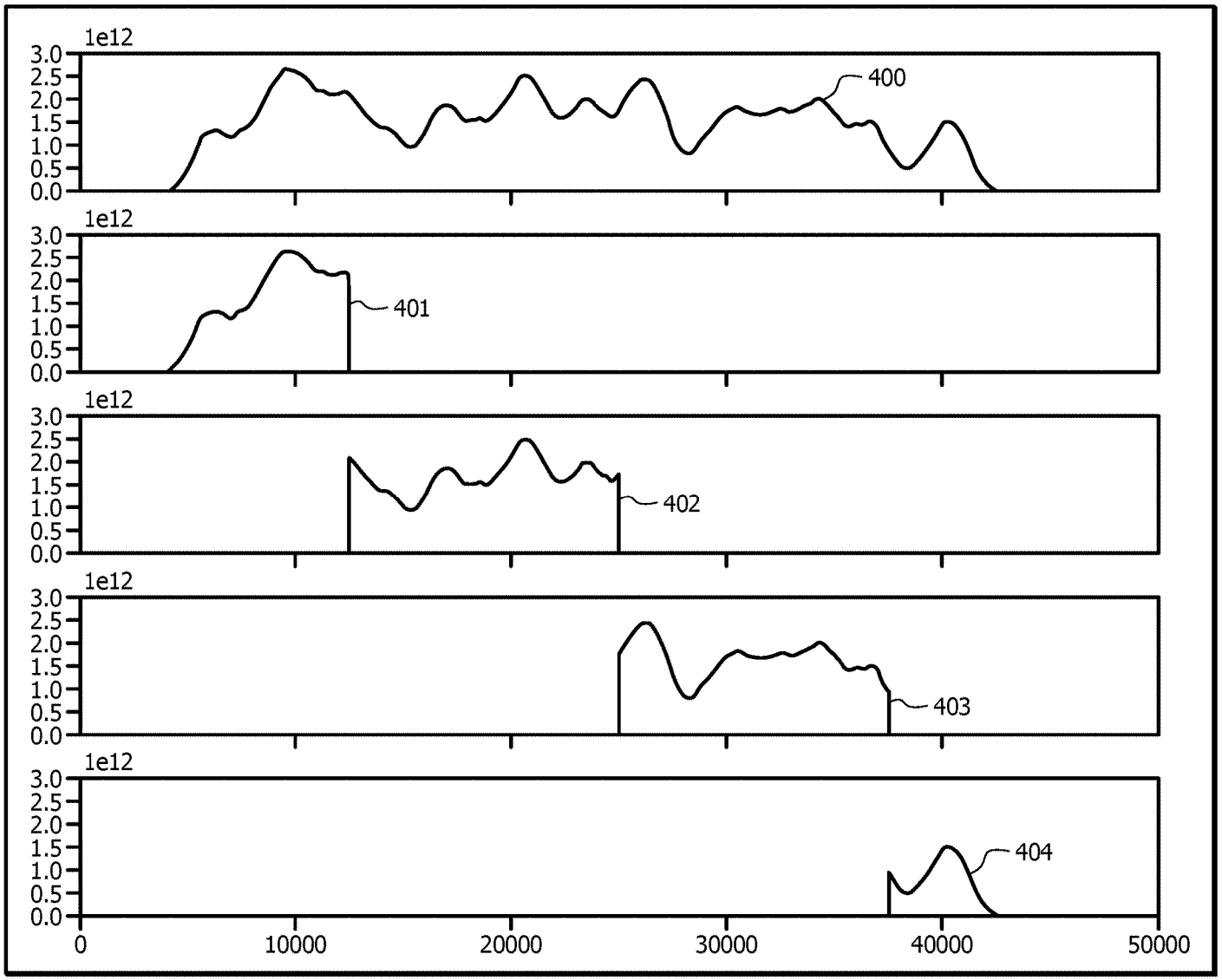
FIG. 4 shows an example embodiment of decomposing a data set into multiple subsets.

Each $d_\alpha$ captures a part of b, and adjacent $d_\alpha$'s may overlap for a smoother transition between them. The important feature of the data chunks is that they are only non-vanishing over a smaller range than the original $b_i$, such as is shown in FIG. 4. FIG. 4 shows a long form data set 400 that is broken into multiple chunks 401, 402, 403 and 404 for processing. For each chunk $d_\alpha$, the following can be solved for the 'chunked' coefficients $x_\alpha$ via deconvolution as in eq. 7.

$$\sum_k c_k x_{\alpha,i-k} = d_{\alpha,i} \quad \text{eq. 9}$$

Since convolution is a linear operation, the desired solution eq. 6 is given by the following.

$$x_i = \sum_\alpha x_{\alpha,i} \quad \text{eq. 10}$$

Figure 5A:
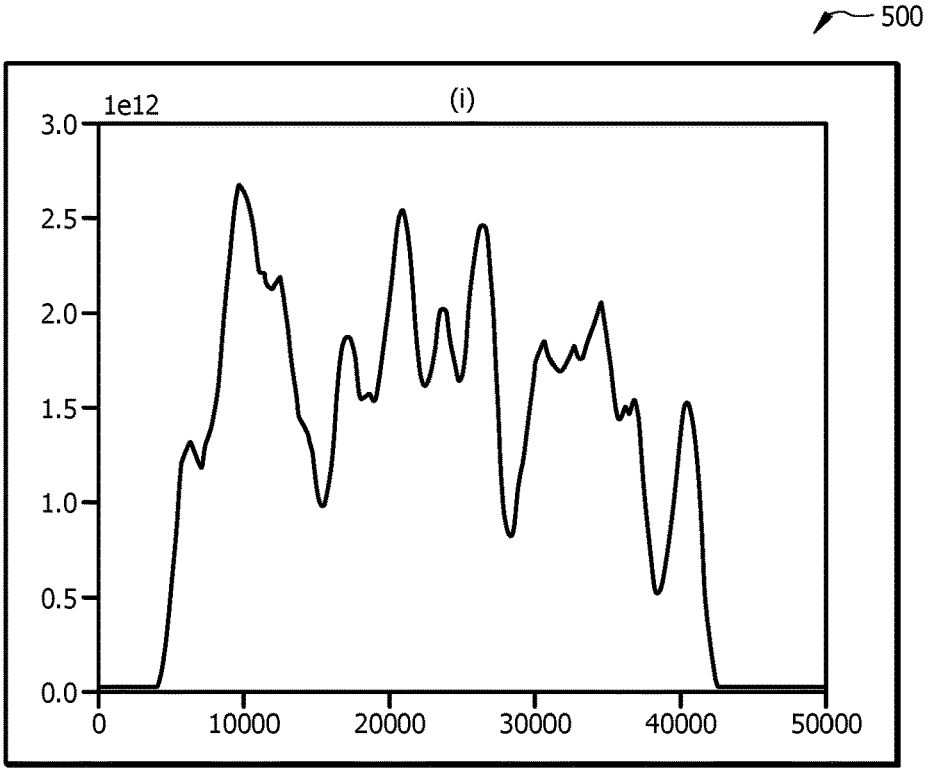
FIGS. 5A and 5B show an example embodiment of an original data vector and an associated autocorrection vector or kernel.
Figure 5B:
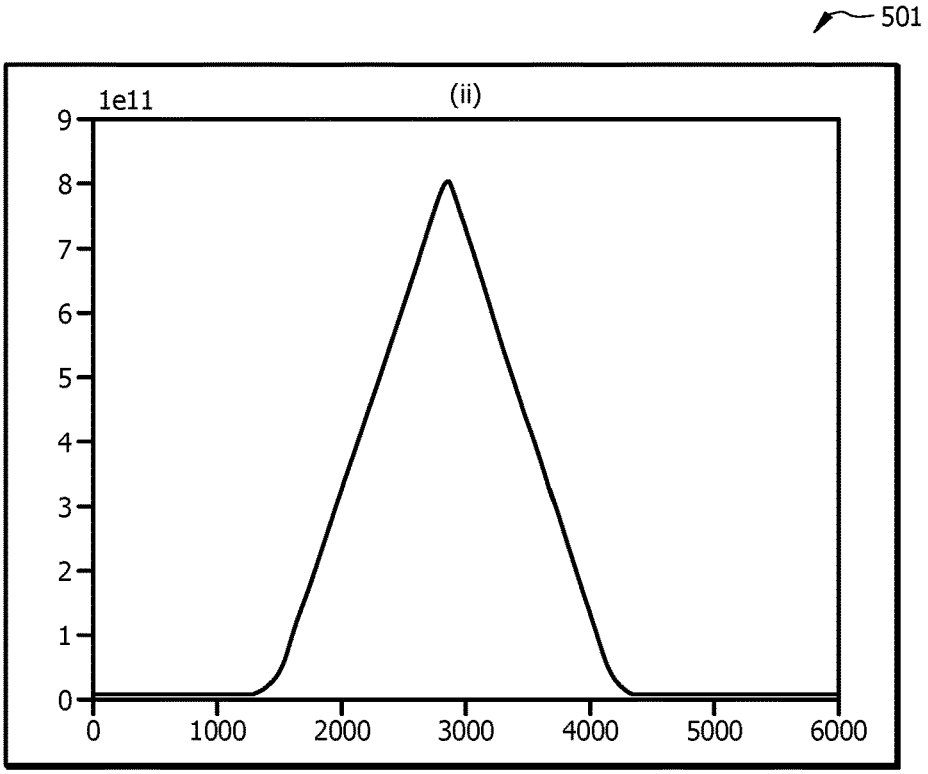

Since the different equations (of different α's) in eq. 9 are completely decoupled from each other, they can be submitted to independent compute cores for parallel execution to improve efficiency. But it is important to point out that, we can gain efficiency only if each of the equations of eq. 9 is of significantly smaller size (dimensionality) than the original eq. 6. At first glance, it seems safe to assume that since the data chunks, $d_\alpha$'s are of more limited range than that of b, the solutions $x_\alpha$'s must be of similarly limited range. Therefore, with minimal padding eq. 9 would be expected to be solved very efficiently (by FT such as in eq. 7). However, this turns out not to be case in general. The range over which the solution, $x_\alpha$, of eq. 9, is not negligibly small could be many times larger than the range of $d_\alpha$. For example, a data vector b 500 of length 50000 and a convolution kernel c 501 of length 5694 are plotted in FIG. 5. Data vector b is chunked into 16 chunks, and the 8-th chunk is chosen as an example. To see the full extent of the deconvolution coefficients of the chunked data, we further pad the chunk to 50000, the same size as the full data vector b. We solve eq. 9 for the deconvolution coefficients x for this padded example chunk. The chunk data 600 and the real part of the deconvolution coefficients 601 are plotted in FIG. 6. While the chunk data 600 is non-zero only over a small range (~4k), the deconvolution coefficients 601 extend well beyond that range. In fact, a zoomed view is plotted in FIG. 7. Only outside of the range (10000-40000) do the magnitudes of the deconvolution coefficients fall below 1e-5, an acceptable threshold. This range is almost 10× the range of non-vanishing chunk data.

The example shows that the $x_\alpha$ can exhibit non trivial 'ringing' beyond the boundary of chunked data, $d_\alpha$. Therefore, to be able to use the chunking concept described in eq 10, the ringing must be canceled or offset effectively.

Embodiments of the system and method described herein corrects for the ringing in a few steps. In step 1, deconvolution with minimal padding is used. For a set of chunked data, with a minimally padded $d_\alpha$, eq. 9 is solved for $x_\alpha$, using the FT technique in eq. 7. Preferred ranges for padding are between 0.5 and 1.0 of the length of the convolution kernel C.

Figure 6A:
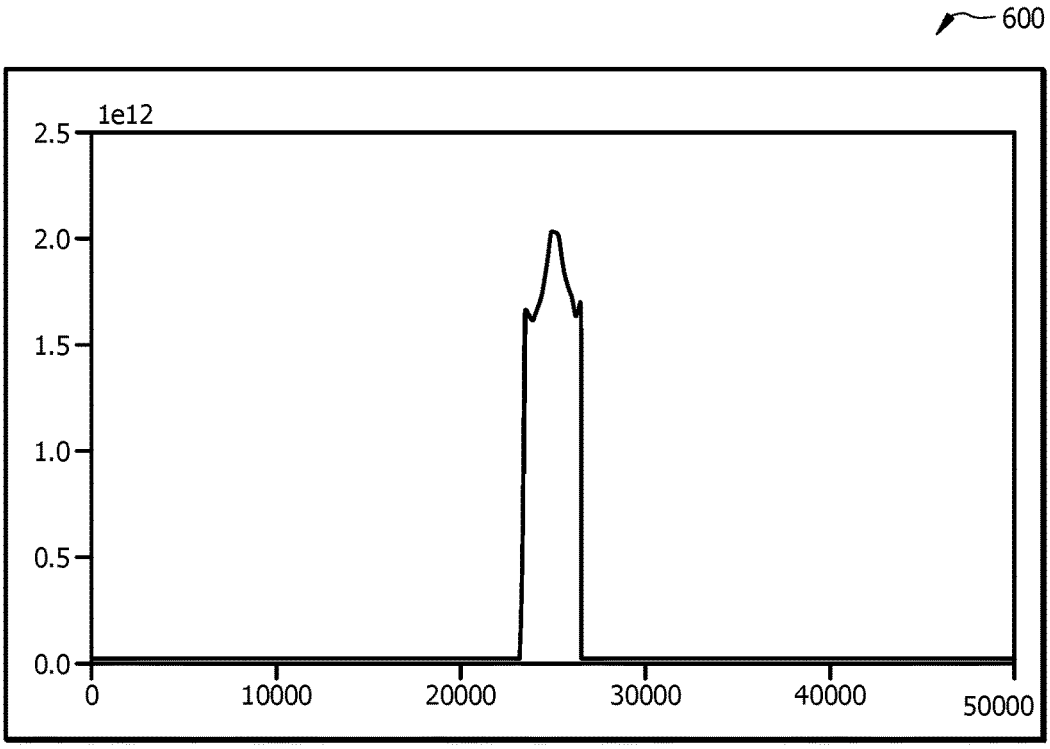
FIGS. 6A, 6B and 7A and 7B show an exemplary subset of data or chunk, zero padded to a length of 50000 points, and the associated real part of the deconvolution coefficients.
Figure 6B:
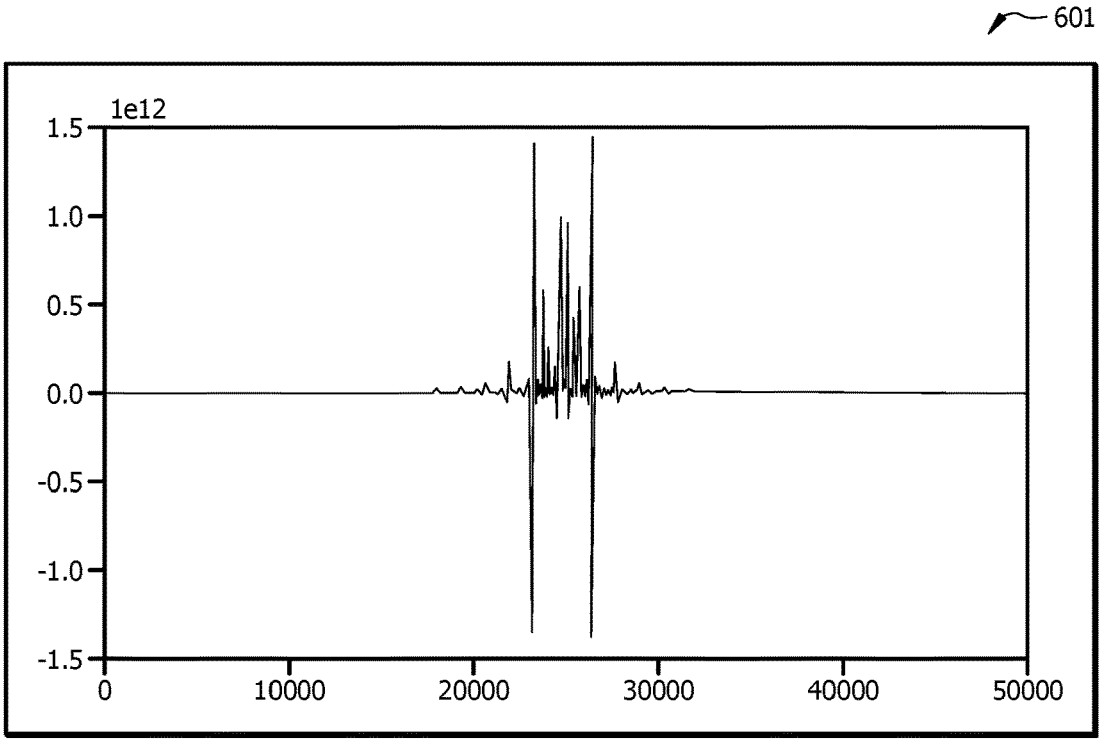
Figure 7A:
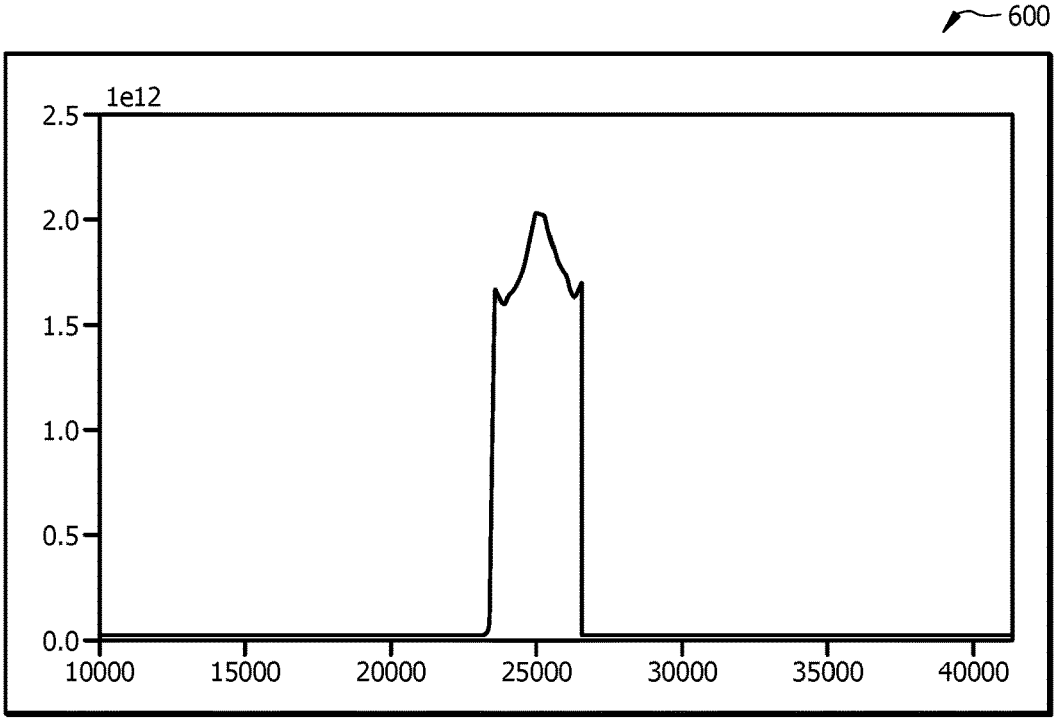
Figure 7B:
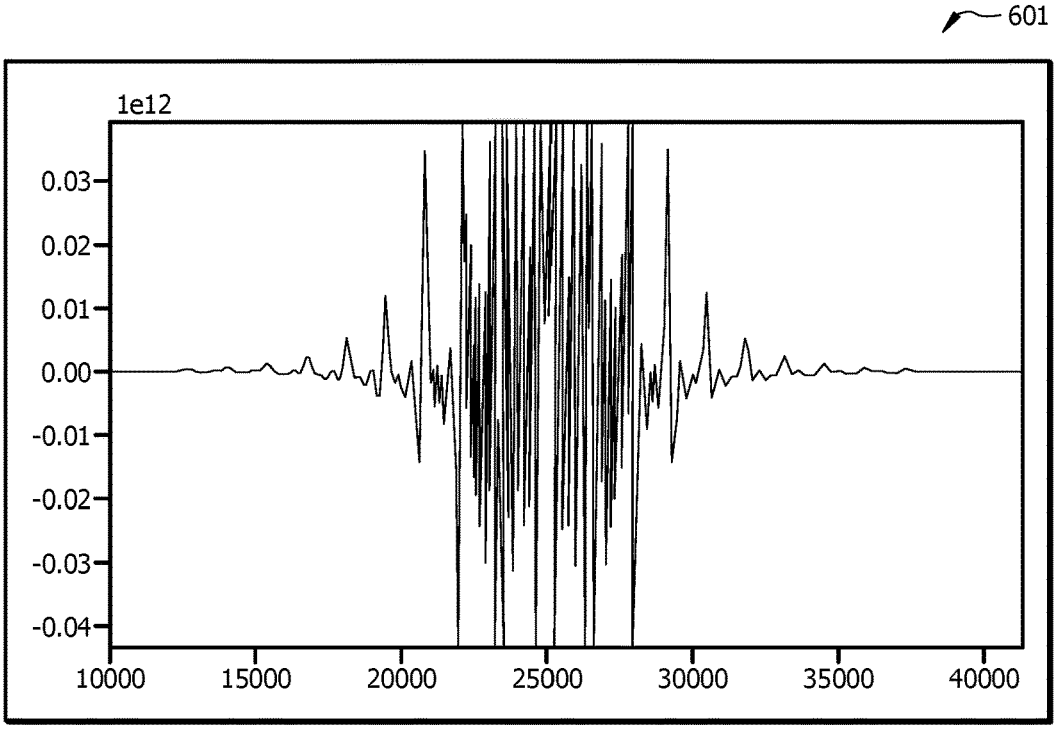
Figure 8:
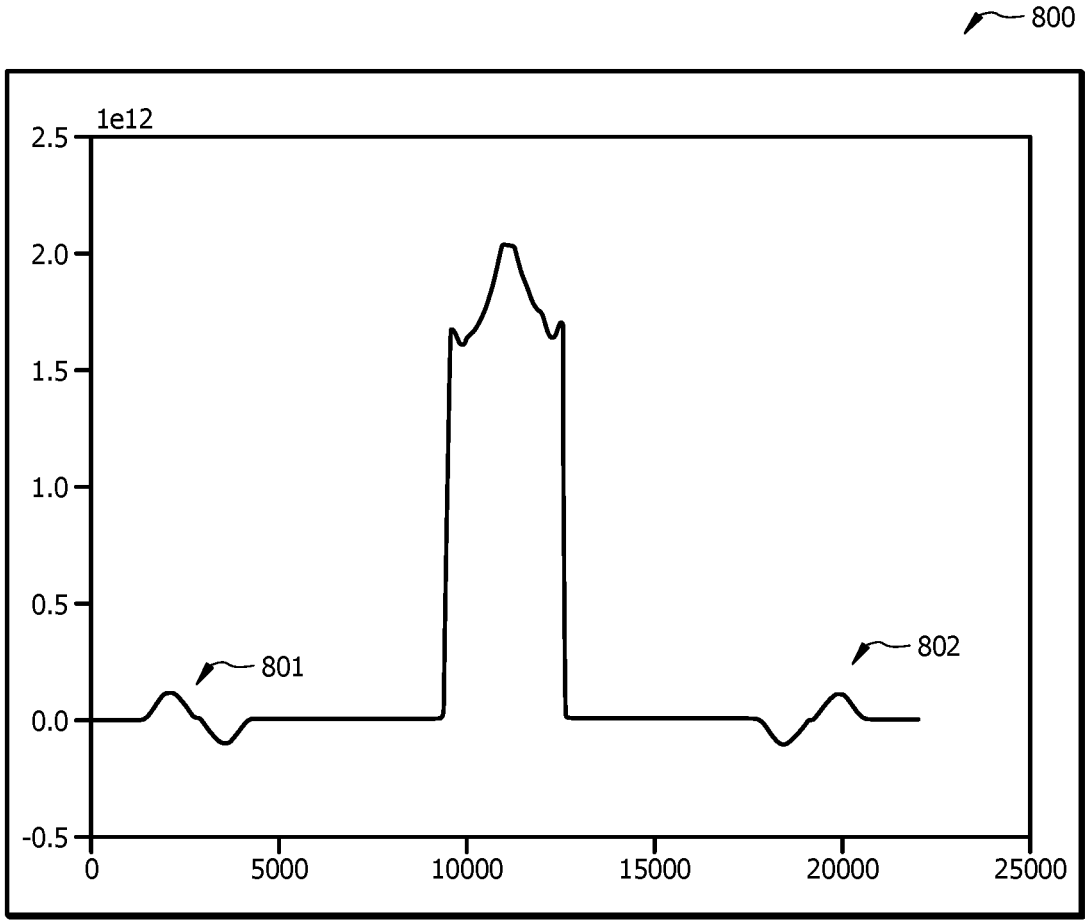
FIG. 8 shows an example of a reconstructed subset of data by full convolution of the deconvolution coefficients of the subset of data zero padded only to about 16000 points.

In step two, resulting overhang is corrected. Extending the solution on either side by zeros beyond the padded range will produce an 'overhang' error. For example, the data chunk used in FIG. 6 is padded to a length of 16k, instead of 50*k*. The deconvolution coefficients are used to reconstruct the chunk data by a full convolution. The reconstructed chunk 800 is shown in FIG. 8. Beyond the padded boundaries, the reconstruction produces a sizable 'overhang' error, one on each end of the reconstruction 801 and 802. The overhang errors, even with a reasonable padding to 16k, result from the deconvolution coefficients failing to damp out sufficiently to zero.

If the overhang errors can be deconvolved the overhangs may be corrected for by subtracting the overhang deconvolution from the solution in deconvolution of step 1. Deconvolving the overhangs must be efficient to constitute an improvement over the brute force solution of eq. 9 with large padding. To make deconvolving the overhangs efficient, the system and method described herein take advantage of the fact that the overhang errors have the following 3 properties.

Figure 9A:
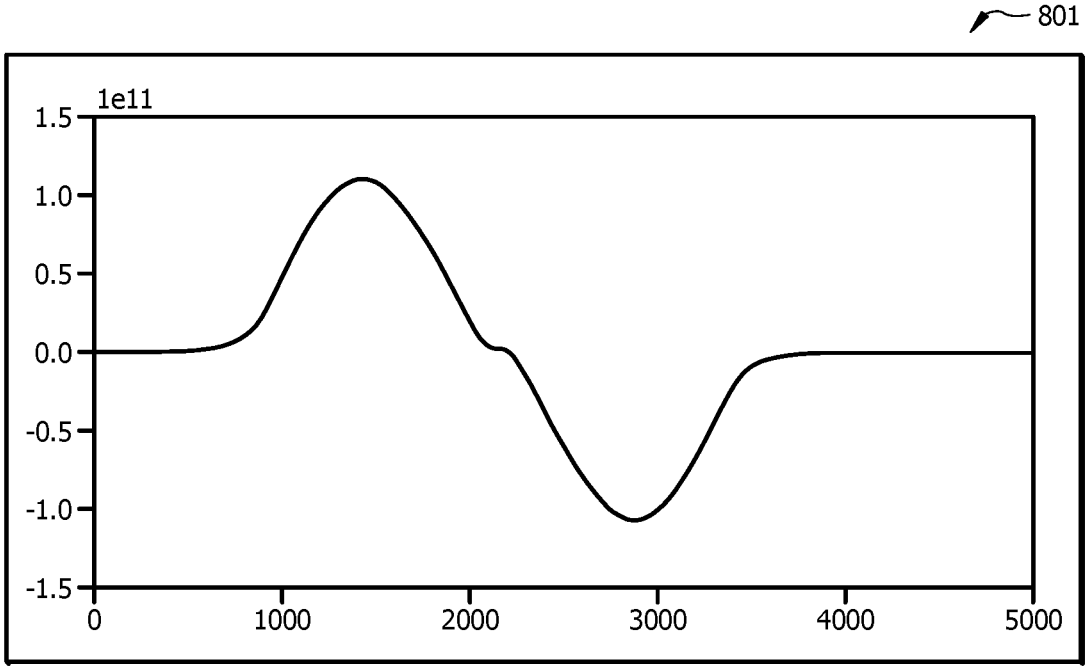
FIGS. 9A, 9B and 10A and 10B show examples of left and right overhangs where
Figure 9B:
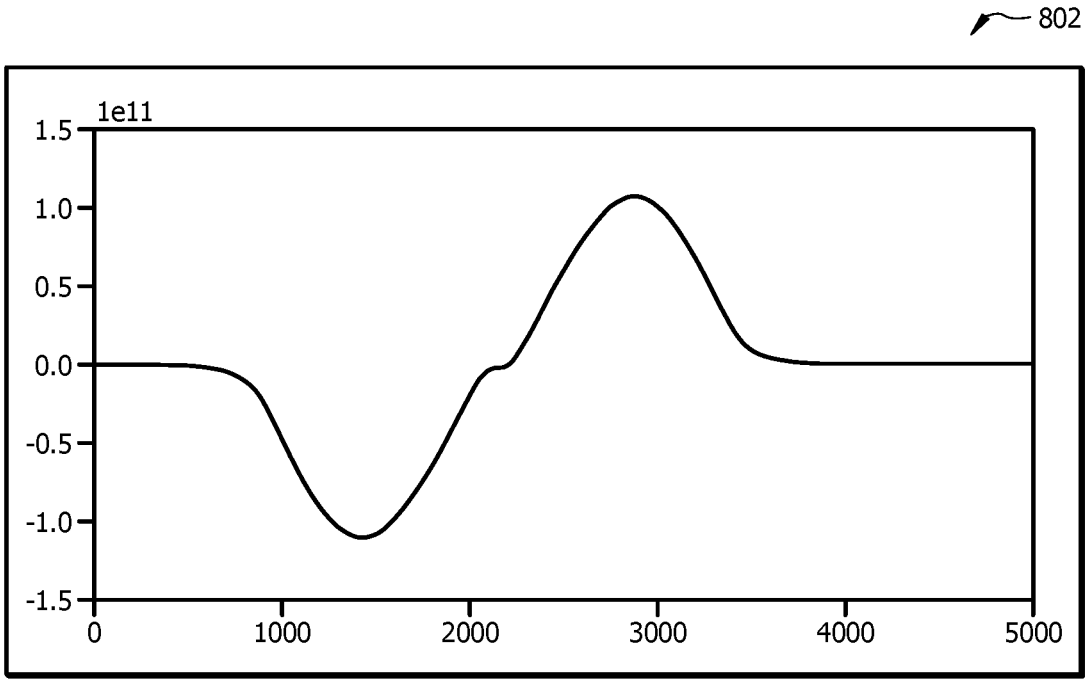

First, the right and the left overhangs 801 and 802 are related to each other by a simple translation and reflection. This is a direct consequence of solving eq. 9 by FT. Periodically extending the solution of eq. 9 will produce a periodically extended $d_\alpha$—the right and left overhang errors must cancel each other after translation. (FIG. 9) Thus the task is simplified to just deconvolving the overhang on one side (right as a convention, though either side may be used).

The overhang can be computed very efficiently. The overhang is essentially the last N points of a full convolution of the solution $x_\alpha$ with the kernel c, where N is the length of c. The last N coefficients of $x_\alpha$ can be used to compute the overhang. Since most relevant instruments use references of limited range, N may be a small number (~5k). Furthermore, FFT can be used to speed up the computation further.

Figure 10A:
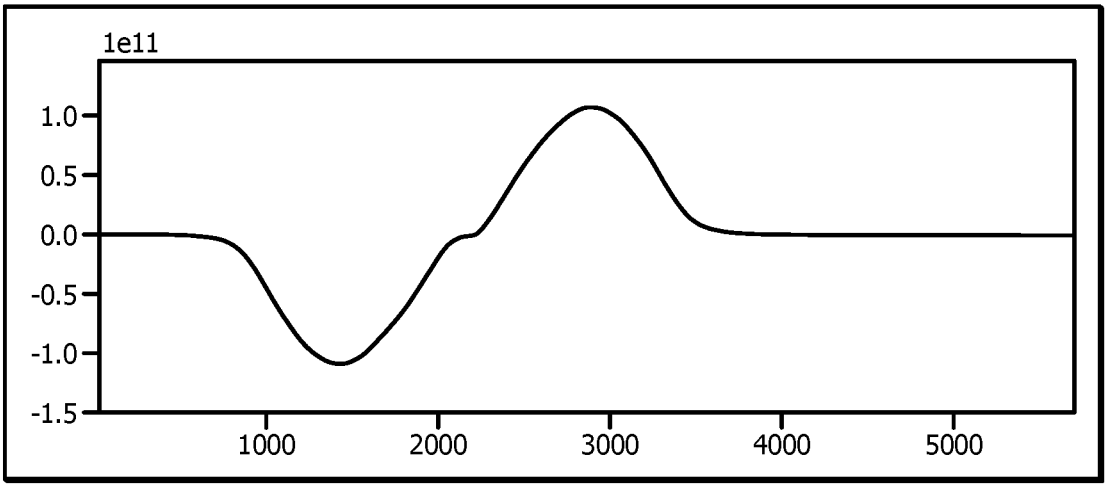
Figure 10B:
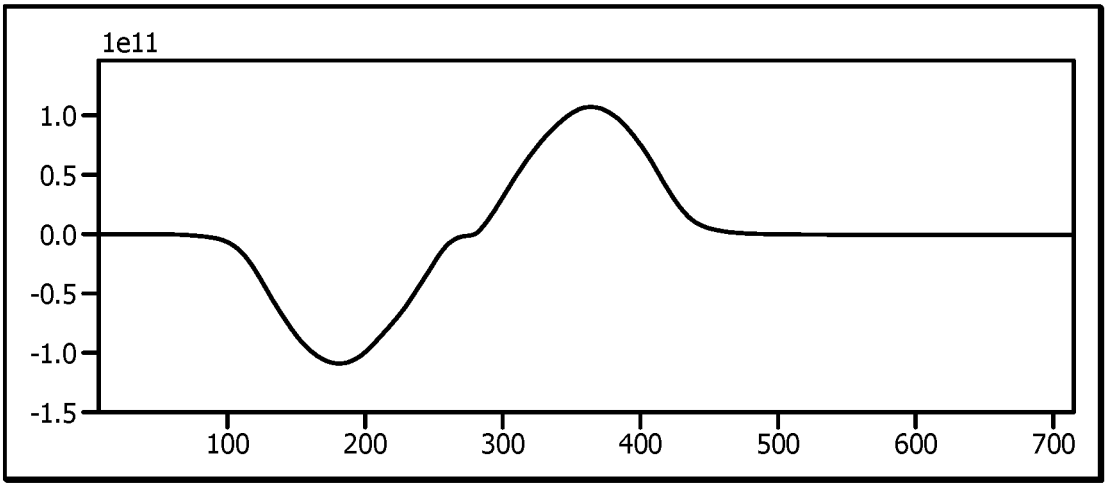
Figure 11A:
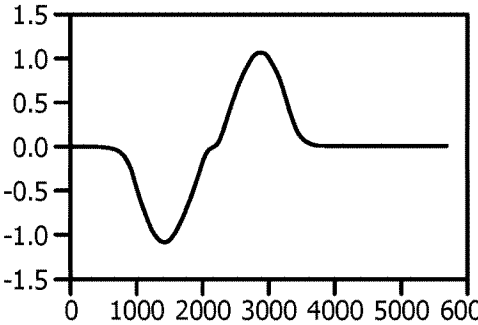
FIGS. 11A-11E show an example workflow of the deconvolution of an overhang using down sampling and up sampling.
Figure 11B:
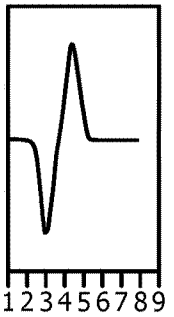
Figure 11C:
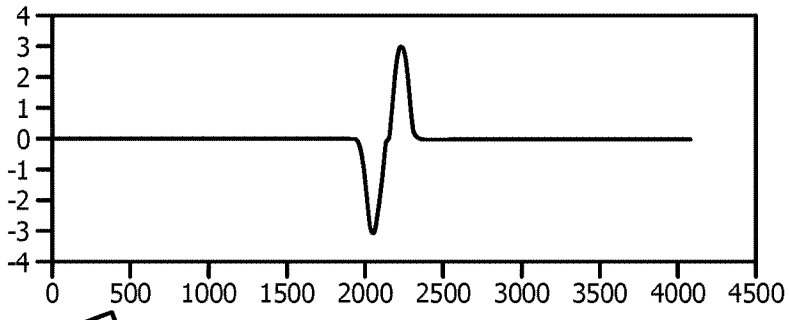
Figure 11D:
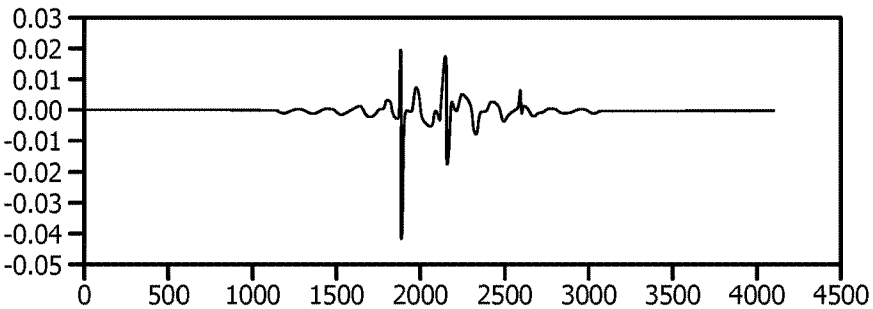
Figure 11E:
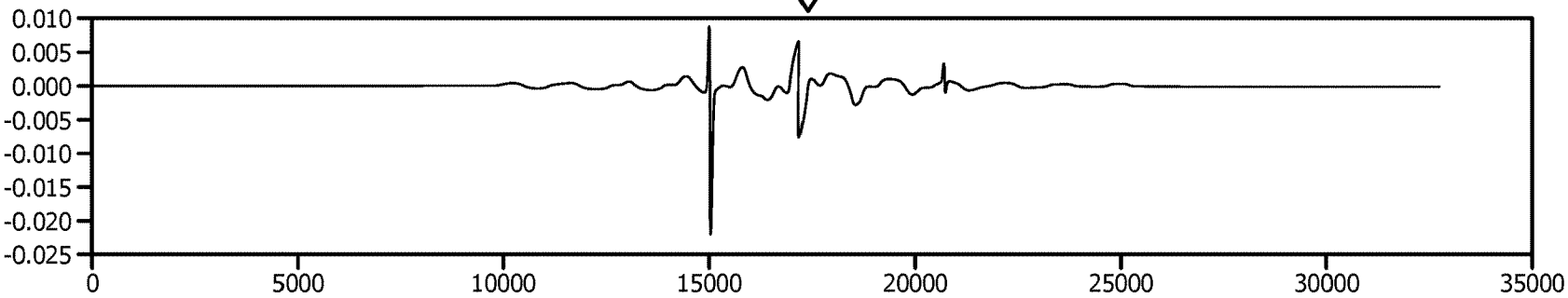

An important property of the overhang is its smoothness. The last N points (corresponding mostly to the padding of $d_\alpha$) of the solution $x_\alpha$ can be used as a correction to the incomplete solution provided by the previous points; these last N points are not the results of deconvolving real data because of padding, so the lack of 'new' input including sharp signals and noise, could contribute to the smoothness of the overhang. Because of the smoothness of the overhang, one can 'downsample' the overhang, i.e. reducing its size without compromising the information content. FIG. 10 shows an example of smoothing by downsampling. Simple downsample techniques may include reduced sampling rate, weighted averaging, or wavelet transform. A full deconvolution (over 32k points, say) of a fully padded overhang can then be accomplished very efficiently by first downsampling the overhang and padding with a 'downsampled' number of zeros, then deconvolve with a downsampled kernel c and finally, upsample the deconvolution coefficients of the downsampled padded overhang to arrive at the full deconvolution.

FIG. 11 shows the basic steps of using downsampling for deconvoluting the overhang. The overhang is computed in (a). A downsampled overhang (size ⅛ of the full overhang) is computed in (b). The downsampled overhang is padded to a target of 4k in (c). Deconvolution coefficients are computed using a downsampled (by ⅛) reference in (d). Finally, in (e), the full deconvolution coefficients of 32k points are reconstructed using upsampling.

Finally, the left overhang deconvolution coefficients may then be easily obtained by a simple translation and reflection of the coefficients from the right overhang. Prepending the left and appending the right overhang deconvolution to the uncorrected deconvolution gives the fully extended set of deconvolution coefficients, with the correct damping behavior, for each chunk.

Figure 12:
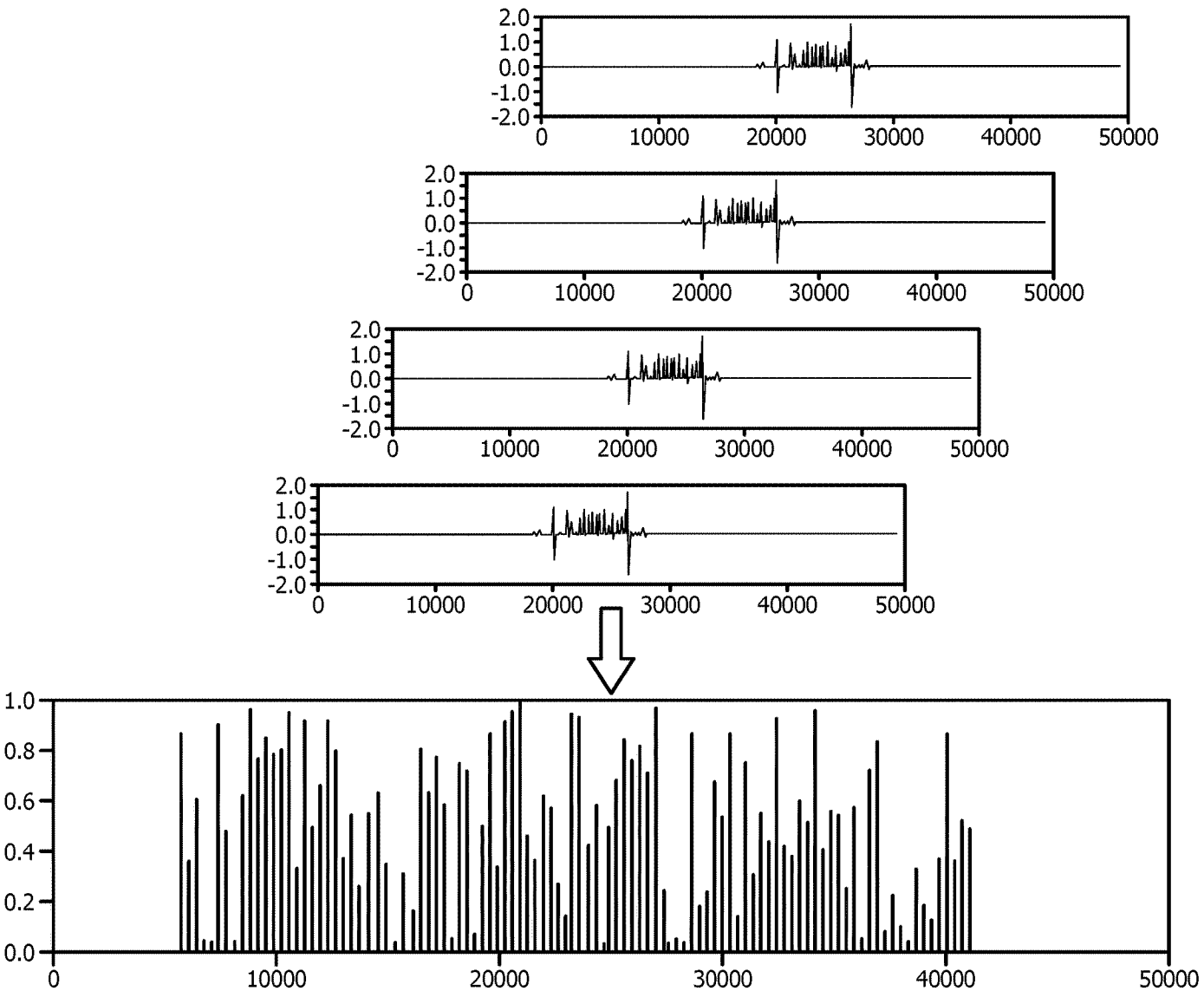
FIG. 12 shows an example a reassembled, corrected set of deconvolution coefficients.

In the third step, the fully deconvolved chunks are reassembled in a straightforward assembly of the fully extended deconvolution coefficients of all the chunks FIG. 12.

In summary, rather than using a straightforward one step deconvolution by extensively padding the chunked data, the present disclosure enables a much more efficient solution to the deconvolution of chunked data (eq 9). The efficiency is gained by first obtaining an approximate solution of the chunk data with minimal padding, and then efficiently correcting the approximate solution using a down sampling procedure.

Chunking—Slowly Varying Reference

As mentioned above, even under exponential ramping, the references over a long scan will no longer be related to each other by simple time translations. However, the differences among neighboring references should be small. The configurations of the voltages affecting the ion motions can be 'tuned' so that the differences among neighbor references can be minimized without affecting the general performance of the spectrometer. Under this assumption, the above approach of the special case of a translation invariant reference can still be used but with the caveat that, the non-zero range of each chunk must be such that over that range, the reference is translation invariant. In addition, a sufficient number of chunks must be used to guarantee that neighbor references differ only minimally. Thus eq. 9 can be solved where c is the convolution kernel corresponding to the appropriate reference for each chunked data. If the neighbor references differ minimally, so do the neighboring deconvolution kernel, c's, in approximation to the desired full solution x of eq. 3.

It is to be understood that features described with regard to the various embodiments herein may be mixed and matched in any combination without departing from the spirit and scope of the disclosure. Although different selected embodiments have been illustrated and described in detail, it is to be appreciated that they are exemplary, and that a variety of substitutions and alterations are possible without departing from the spirit and scope of the present disclosure.

What is claimed is:

1. A method for processing long scan data from a mass spectrometer, comprising:

breaking the long scan data into multiple discrete subsets;

padding each of the multiple subsets by adding additional strings of data on either end of the subset;

deconvolving each of the multiple subsets, each with a corresponding reference;

correcting for overhang errors on each deconvolved subset, the overhead errors resulting from deconvolution coefficients failing to damp out to zero; and assembling the deconvolved subsets into a deconvolved full data set.

2. The method of claim 1, wherein correcting for overhang errors comprises:

computing an overhang correction for a first one of the overhangs by deconvolving the overhang data;

smoothing the overhang correction; and translating the first overhang correction to determine a second overhang correction for a second one of the overhangs; and appending the first and second overhang corrections to the corresponding deconvolved subsets.

3. The method of claim 2 wherein smoothing the overhang correction is accomplished by downsampling.

4. The method of claim 1 wherein each corresponding reference is translation invariant.

5. The method of claim 1 wherein the multiple references are not translation invariant.

6. The method of claim 1 wherein a length of the padding is between 0.5 and 1 of a length of a convolution kernel.

7. The method of claim 1 wherein padding each of the multiple data subsets comprises adding zeroes to either end of the subsets.

8. The method of claim 1 wherein correcting the overhang is performed iteratively.

9. A mass spectrometer, comprising:

a multipole configured to pass an ion stream, the ion stream comprising an abundance of one or more ion species within stability boundaries defined by (a, q) values;

a detector configured to detect the spatial and temporal properties of the abundance of ions; and a processing system configured to record and store a pattern of detection of ions in the abundance of ions by the dynodes in the detector, wherein the processing system is operable to break the long scan data into multiple discrete subsets;

deconvolve each of the multiple subsets, each with a corresponding reference; correct for overhang errors on each deconvolved subset the overhead errors resulting from deconvolution coefficients failing to damp out to zero; and assemble the deconvolved subsets into a deconvolved full data set.

10. The mass spectrometer of claim 9, wherein correcting for overhang errors comprises:

computing an overhang correction for a first one of the overhangs by deconvolving the overhang data;

smoothing the overhang correction; and translating the first overhang correction to determine a second overhang correction for a second one of the overhangs; and appending the first and second overhang corrections to the corresponding deconvolved subsets.

11. The method of claim 10 wherein smoothing the overhang correction is accomplished by downsampling.

12. The mass spectrometer of claim 9 wherein the processing system is further configured to pad each subset before deconvolving.

13. The mass spectrometer of claim 12 wherein a length of the padding is between 0.5 and 1 of a length of a convolution kernel.

14. The mass spectrometer of claim 12 wherein padding each of the multiple data subsets comprises adding zeroes to either end of the subsets.

15. The method of claim 9 wherein correcting the overhang is performed iteratively.

16. A high mass resolving power high sensitivity multipole mass spectrometer method, comprising:

providing reference signals;

acquiring spatial and temporal raw data of an abundance of one or more ion species from an exit channel of the multipole;

breaking the acquired data into two or more chunks;

deconvolving each of the two or more chunks of data using the corresponding reference signals;

correcting for overhang errors for each of the two or more chunks of data by computing a deconvolution of one overhang, translating and reflecting he deconvolved overhang to obtain the corresponding second overhang and prepending the first and second deconvolved overhangs to the associated chunk of the two or more chunks of data the overhead errors resulting from deconvolution coefficients failing to damp out to zero; and reassembling the fully deconvolved and overhang corrected chunks into a fully deconvolved data set.

17. The method of claim 16 wherein the multiple references are translation invariant.

18. The method of claim 16 wherein the multiple references are not translation invariant.

19. The method of claim 16 wherein correcting the overhang is performed iteratively.

20. The method of claim 16 wherein correcting for overhang errors further comprises smoothing the overhang correction by downsampling.

* * * * *